US007518590B2

(12) United States Patent
Yoshimoto

(10) Patent No.: US 7,518,590 B2
(45) Date of Patent: Apr. 14, 2009

(54) DRIVING CIRCUIT AND DRIVING METHOD OF ELECTRO-OPTICAL DEVICE, ELECTRO-OPTICAL DEVICE, AND ELECTRONIC APPARATUS

(75) Inventor: Hiroshi Yoshimoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 634 days.

(21) Appl. No.: 11/180,565

(22) Filed: Jul. 14, 2005

(65) Prior Publication Data

US 2006/0022931 A1 Feb. 2, 2006

(30) Foreign Application Priority Data

Jul. 27, 2004 (JP) ..... 2004-218541
Jun. 3, 2005 (JP) ..... 2005-163567

(51) Int. Cl.
*G09G 3/36* (2006.01)

(52) U.S. Cl. ..... 345/98; 345/103

(58) Field of Classification Search ..... 345/87, 345/90, 98, 99, 100, 96, 213, 204, 208, 55, 345/103, 211, 212, 92; 348/556, 792
See application file for complete search history.

(56) References Cited

U.S. PATENT DOCUMENTS 6,624,801 B2 * 9/2003 Moriyama ..... 345/100
7,042,429 B2 * 5/2006 Miyazawa et al. ..... 345/89
7,362,304 B2 * 4/2008 Takatori et al. ..... 345/103

FOREIGN PATENT DOCUMENTS

JP A-2004-177930 6/2004

* cited by examiner

*Primary Examiner*—Abbas I Abdulselam
(74) *Attorney, Agent, or Firm*—Oliff & Berridge, PLC

(57) ABSTRACT

A driving circuit for an electro-optical device drives an electro-optical device an image display region driven by a scanning line driving circuit that drives a plurality of scanning lines. The image display region is divided into a plurality of partial regions. The scanning line driving circuit supplies scanning signals alternately to the partial regions and sequentially to a plurality of scanning lines in the respective partial regions, and an image signal supply circuit supplies image signals to a plurality of data lines such that each of the plurality of partial regions is subjected to horizontal scanning in a 1/n horizontal scanning period. The scanning line driving circuit supplies the scanning signals such that a scanning line, which is disposed at an edge of one side in the image display region, is the last for each field period.

11 Claims, 17 Drawing Sheets

DRIVING CIRCUIT AND DRIVING METHOD OF ELECTRO-OPTICAL DEVICE, ELECTRO-OPTICAL DEVICE, AND ELECTRONIC APPARATUS

This application claims the benefit of Japanese Patent Applications No. 2004-218541 filed Jul. 27, 2004 and No. 2005-163567 filed Jun. 3, 2005. The entire disclosure of the prior applications is hereby incorporated by reference herein in its entirety.

BACKGROUND OF THE INVENTION

1. Technical Field

The present invention relates to driving circuit and driving method of an electro-optical device, such as a liquid crystal device, to an electro-optical device having the driving circuit, and to an electronic apparatus having the electro-optical device, such as a liquid crystal projector.

2. Related Art

As an example of an electro-optical device that is driven by this type of driving circuit, a liquid crystal device that has data lines and scanning lines wired vertically and horizontally in an image display region on a substrate and pixel units formed to correspond to intersections of the data lines and the scanning lines is exemplified.

In such a liquid crystal device, for example, a display data generating circuit generates horizontal synchronizing signals, vertical synchronizing signals, and display data based on a source signal, which is supplied from a personal computer, a video cassette recorder, or the like. Then, the driving circuit drives the respective pixel units based on the horizontal synchronizing signals, the vertical synchronizing signals, and display data. Moreover, in general, the horizontal synchronizing signals are generated such that an interval between output timings of two continuous horizontal synchronizing signals, that is, one horizontal scanning period, is basically made constant on the time axis.

The present inventors have already suggested a driving method in which the image display region is divided into a plurality of partial regions by division lines according to the scanning lines and image display is performed by region scanning. That is, according to this driving method, a driving circuit generates scanning signals based on the horizontal synchronizing signals and the vertical synchronizing signals and supplies the scanning signals to the respective partial regions alternately and to the respective scanning lines sequentially. Further, image signals, which are generated by the driving circuit based on display data are supplied to the respective data lines such that, as for two partial regions in a pair among the plurality of partial regions, the pixel units of one of the two partial regions and the pixel units of the other partial region are driven based on image signals having different polarities with respect to a reference potential at the cycle at which the scanning lines are selected. According to such a driving method, when the number of partial regions is two, in one field period, which is defined by an interval between output timings of two vertical synchronizing signals, the image signals for displaying one screen are written into the respective pixel units two times, while their polarities are changed.

Japanese Unexamined Patent Application Publication No. 2004-177930 is an example of the related art.

For example, when the video standard of a display device of the personal computer is SVGA (Super VGA (Video Graphic Adapter)) and the video standard of the liquid crystal device is XGA (Extended Graphic Array), the display device and the liquid crystal device are different in the total number of pixels or the driving frequency for image display. For this reason, down-conversion or up-conversion may be performed; in this conversion, a source signal or source data having a different total number of pixels or driving frequency is converted so as to match the liquid crystal device. During the conversion, the total number of horizontal synchronizing signals may not be an integer multiple of the total number of vertical synchronizing signals. As a result, in one field period, almost all the horizontal scanning periods can be made constant, but the last horizontal scanning period may not be made constant. Specifically, in the respective field periods, the last horizontal synchronizing pulse may not have the constant interval.

The source signal, which is generated when a video tape is played on the video cassette recorder, is influenced by damage to the video tape, for example, stretching and shrinkage. For this reason, signal processing may be performed so as to make the horizontal scanning period constant. With the signal processing, almost all the horizontal scanning periods in one field period can be made constant, but the last horizontal scanning period may not have the constant interval.

As such, when the last horizontal scanning period does not have the constant interval, in the above-described region scanning method, the image signals may not be normally written into the pixel units corresponding to the scanning line, to which the last scanning signal of one field period is supplied, in the respective partial regions. This is because there exists an inconsistency because the image signals to be written into the pixel units corresponding to the scanning line, to which the last scanning signal is supplied, are written into only some of the pixel units or sufficient write time for the image signals is not secured. In particular, when an edge of one partial region, which is subjected to region scanning, is positioned at the center of the image display region or in the periphery thereof, the abnormal writing operation of the image signals described above may cause noticeable display defects.

SUMMARY

An advantage of the invention is that it provides a driving circuit and a driving method of an electro-optical device that, even when image display is performed by region scanning and even when the above-described inconsistency occurs, can reduce an influence on a display screen, that is, can perform normal image display. The invention also provides an electro-optical device having such a driving circuit and an electronic apparatus having such an electro-optical device.

According to a first aspect of the invention, there is provided a driving circuit for an electro-optical device that drives an electro-optical device having, on an image display region on a substrate, a plurality of data lines and a plurality of scanning lines, and a plurality of pixel units electrically connected to the scanning lines and the data lines. The driving circuit for an electro-optical device includes a scanning line driving circuit that, with respect to a plurality of partial regions, which are obtained by dividing the image display region by division lines along the scanning lines, supplies scanning signals alternately to the scanning lines in different partial regions, and an image signal supply circuit that generates image signals based on display data and supplies the image signals to the plurality of data lines such that each field period, which is defined by a vertical synchronizing signal according to display data, has a vertical retrace period and such that each of the plurality of the partial regions is subjected to horizontal scanning in a 1/n horizontal scanning period obtained by dividing one horizontal scanning period, which is defined by a horizontal synchronizing signal according to display data, by the total number n, where n is a natural number of two or more, of the plurality of partial regions. The scanning line driving circuit supplies the scanning signals such that the supply sequence of the scanning signal to one scanning line, which is disposed at an edge of one side along the scanning lines in the image display region, among the plurality of scanning lines becomes the last for each field period.

In an electro-optical device, which is driven by the driving circuit according to the first aspect of the invention, the respective pixel units in the image display region includes display elements, such as liquid crystal elements or the like, pixel switching elements, such as thin film transistors (hereinafter, suitably referred to as "TFTs") or the like, as driving elements for driving the display elements, and the like. In this case, in the respective pixel units, the display elements are electrically connected to the scanning lines and the data lines via the pixel switching elements.

When the electro-optical device is driven, a source signal is supplied from a video cassette recorder, a personal computer, or the like to the electro-optical device. Then, based on the source signal, the following processes are performed in an external circuit of the electro-optical device, such that display data, and a horizontal synchronizing signal and a vertical synchronizing signal according to display data are generated. For example, based on the source signal, in the external circuit of the electro-optical device, the above-described down-conversion or up-conversion is performed or signal processing is performed to make the horizontal scanning period constant in a source signal, which is generated by the video cassette recorder or the like and has a jitter in the time-axis direction. Thus, display data generated in such a manner may be outputted as incomplete display data in which the horizontal scanning period is not made constant at the end of each field period. On the contrary, according to the first aspect of the invention, the inconsistency generated when display is performed by, in particular, region scanning based on such incomplete display data does not actually appear on a display image.

Then, based on the horizontal synchronizing signal and the vertical synchronizing signal, and display data, in the image display region of the electro-optical device, region scanning is performed as follow.

The scanning line driving circuit generates the scanning signals at the timing based on the horizontal synchronizing signal in one field period and outputs the scanning signals alternately to the respective partial regions and sequentially, for example, linear-sequentially, to the plurality of scanning lines. For example, when the total number n of the plurality of partial regions is two, the scanning signals are supplied to one of two partial regions in a first half horizontal scanning period of one horizontal scanning period and are supplied to the other partial region in a second half horizontal scanning period of one horizontal scanning period.

Further, in the first half horizontal scanning period of one horizontal scanning period, the image signals supplied from the image signal supply circuit are supplied to the pixel units corresponding to the scanning line in the one partial region, to which the scanning signal is supplied, via the data lines. In each of the pixel units, for example, the pixel switching element is supplied with the scanning signal from the scanning line to be turned on and then the image signal is supplied to the display element from the corresponding data line via the pixel switching element. Then, the display element performs image display based on the image signal.

Further, in the second half horizontal scanning period of one horizontal scanning period, the image signals supplied from the image signal supply circuit are supplied to the pixel units corresponding to the scanning line in the other partial region, to which the scanning signal is supplied, via the data lines. Then, the pixel units perform image display, like the pixel units of the one partial region.

As such, when the total number n of the plurality of partial regions is two, two partial regions are alternately subjected to horizontal scanning in one horizontal scanning period in one field period. Here, in the second half horizontal scanning period of the last horizontal scanning period of one field period, a last scanning signal is supplied to the other partial region. In the other partial region, the last scanning signal is supplied to one scanning line facing one side along the scanning lines in the image display region and the pixel units corresponding to this scanning line are subjected to horizontal scanning. Then, if horizontal scanning in the other partial region ends, the vertical retrace period starts, and one field period ends.

Accordingly, even when the last horizontal scanning period is inconstant, if the last horizontal scanning period has the length equal to or larger than that of the half horizontal scanning period, a display failure does not occur to an extent that it can be viewed on the display screen to be displayed in the image display region. That is, if the last horizontal scanning period has the length equal to or larger than that of the half horizontal scanning period and is inconstant, the write operation of the image signals to the pixel units corresponding to the one scanning line may not be normally performed. In this case, however, even when the image signals are made incomplete due to the inconstant horizontal scanning period not to be normally written, since the pixel units, to which incomplete image signals are written, are disposed at an edge of the image display region, the display failure does not occur to the extent that it can be viewed on the display screen. Such pixel units may be present at the edge of the image display region to some extent or may be disposed in a region that is blocked by a frame or the like. Further, such pixel units may be dummy pixel units.

Further, if the last horizontal scanning period ends in the vertical retrace period, the write operation of the image signals to the respective pixel units in the image display region is normally performed, and thus the display screen is not influenced.

As a result, according to the first aspect of the invention, the inconsistency generated when display is performed by region scanning based on incomplete display data in the last horizontal scanning period of each field period does not actually appear on the display screen, thereby enhancing image quality.

Though the case in which the total number n of the plurality of partial regions is two has been described, according to the driving circuit for an electro-optical device of the invention, if the deviation from the constant period of the last horizontal scanning period of one field period on the time axis is suppressed to be equal to or less than the 1/n horizontal scanning period with respect to the total number n of the partial regions to the maximum, the above-described advantage can be obtained. That is, the degree of freedom for the signal processing in the external circuit of the electro-optical device can be increased. Further, the margin for the time deviation according to the last horizontal scanning period of each field period can be made relatively large, thereby achieving superior practicability.

In the driving circuit for an electro-optical device according to the first aspect of the invention, it is preferable that the image signal supply circuit generates the image signals such that the image display region is subjected to vertical scanning in a 1/n field period obtained by dividing one field period by the total number n.

According to this configuration, one screen is displayed on the image display region for each 1/n field period. That is, n screens can be displayed on the image display region in one field period.

In the driving circuit for an electro-optical device according to the first aspect of the invention, it is preferable that the image signal supply circuit generates the image signals while adjusting polarities of the image signals to any one of positive and negative voltages with respect to a reference potential.

According to this configuration, the image signal supply circuit supplies the image signals to two partial regions in pairs among the plurality of partial regions in the image display region such that the pixel units of one partial region and the pixel units of the other partial region perform image display based on the image signals having different polarities. Further, the image signal supply circuit supplies the image signals having different polarities to the pixel units of the respective partial regions at a predetermined cycle. Accordingly, for each partial region in the image display region, surface inversion driving can be performed.

The driving circuit for an electro-optical device according to the first aspect of the invention further includes a correction circuit that adjusts the length of a last horizontal scanning period in one field period based on the vertical synchronizing signal and the horizontal synchronizing signal such that the last horizontal scanning period ends in a period from the start of a supply period of a last scanning signal to the end of the vertical retrace period.

According to this configuration, the length of the last horizontal scanning period is adjusted by the correction circuit, and thus the deviation from the constant period of the last horizontal scanning period of one field period on the time axis is adjusted. Accordingly, the last horizontal scanning period can be allowed to end in the supply period of the last scanning signal or in the vertical retrace period. Thus, according to this configuration, the inconsistency generated when display is performed by region scanning based on incomplete display data in the last horizontal scanning period of each field period can be made not to actually appear on the display screen.

In the driving circuit for an electro-optical device according to the first aspect of the invention, it is preferable that the number of the plurality of partial regions is two, and the scanning line driving circuit supplies the scanning signals alternately to the two partial regions and linear-sequentially to the scanning lines in the respective partial regions.

According to this configuration, if the last horizontal scanning period of one field period has the length equal to or larger than that of the half horizontal scanning period, the inconsistency generated when display is performed by region scanning based on incomplete display data in the last horizontal scanning period of each field period can be made not to actually appear on the display screen.

In the driving circuit for an electro-optical device according to the first aspect of the invention, it is preferable that the number of the plurality of partial regions is four, and the scanning line driving circuit supplies the scanning signals alternately to the four partial regions and linear-sequentially to the scanning lines in the respective partial regions.

According to this configuration, the image signals are written into the pixel units of the respective partial regions for each quarter horizontal scanning period in one horizontal scanning period. Then, in the last horizontal scanning period of one field period, the pixel units corresponding to one scanning line that faces one side along the scanning lines in the image display region are subjected to horizontal scanning in the last quarter horizontal scanning period. Accordingly, if the last horizontal scanning period has the length equal to or larger than that of the ¾ horizontal scanning period, the inconsistency generated when display is performed by region scanning based on incomplete display data in the last horizontal scanning period of each field period can be made not to actually appear on the display screen.

According to a second aspect of the invention, an electro-optical device includes the above-described driving circuit for an electro-optical device according to the first aspect of the invention (including various configurations).

According to the electro-optical device according to the second aspect of the invention, the electro-optical device is driven by the above-described driving circuit for an electro-optical device according to the first aspect of the invention, thereby enhancing the quality of a display image in the image display region.

According to a third aspect of the invention, an electronic apparatus includes the above-described electro-optical device according to the second aspect of the invention.

The electronic apparatus according to third aspect of the invention includes the above-described electro-optical device according to the second aspect of the invention. Therefore, various electronic apparatuses that perform high-quality image display, such as a projection-type display device, a television, a cellular phone, an electronic organizer, a word processor, a view-finder-type or monitor-direct-view-type video tape recorder, a work station, a video phone, a POS terminal, a touch panel, or the like, can be implemented. Further, the electronic apparatus of the third aspect of the invention can include an electrophoretic device, such as an electronic paper, an electron emission device (Field Emission Display or Conduction Electron-Emitter Display), or a digital light processing (DLP) as an apparatus using the electrophoretic device or the electron emission device.

According to a fourth aspect of the invention, there is provided a driving method for an electro-optical device that drives an electro-optical device having, on an image display region on a substrate, a plurality of data lines and a plurality of scanning lines, and a plurality of pixel units electrically connected to the scanning lines and the data lines. The driving method for an electro-optical device includes, supplying, with respect to a plurality of partial regions, which are obtained by dividing the image display region by division lines along the scanning lines, scanning signals alternately to the scanning lines in different partial regions, and generating image signals based on display data and supplying the image signals to the plurality of data lines such that each field period, which is defined by a vertical synchronizing signal according to display data, has a vertical retrace period and such that each of the plurality of the partial regions is subjected to horizontal scanning in a 1/n horizontal scanning period obtained by dividing one horizontal scanning period, which is defined by a horizontal synchronizing signal according to display data, by the total number n, where n is a natural number of two or more, of the plurality of partial regions. In supplying the scanning signals, the scanning signals are supplied such that the supply sequence of the scanning signal to one scanning line disposed at an edge of one side along the scanning lines in the image display region among the plurality of scanning lines becomes the last for each field period.

In the driving method for an electro-optical device according to the fourth aspect of the invention, like the above-described driving circuit for an electro-optical device, the inconsistency generated when display is performed by region scanning based on incomplete display data in the last horizontal scanning period of each field period does not actually appear on the display screen, thereby enhancing the image quality. Further, the degree of freedom for the signal processing in the external circuit of the electro-optical device can be increased and also the margin for the time deviation according to the last horizontal scanning period of each field period can be made relatively large, thereby achieving superior practicability.

In the driving method for an electro-optical device according to the fourth aspect of the invention, it is preferable that, in generating the image signals, the image signals are generated such that the image display region is subjected to vertical scanning in a 1/n field period obtained by dividing one field period by the total number n.

According to this configuration, in one field period, n screens can be displayed on the image display region.

In the driving method for an electro-optical device according to the fourth aspect of the invention, it is preferable that, in generating the image signals, the image signals are generated while polarities of the image signals are adjusted to any one of positive and negative voltages with respect to a reference potential.

According to this configuration, for each partial region in the image display region, surface inversion driving can be performed.

The effects and advantages of the invention will be apparent from embodiments described below.

BRIEF DESCRIPTION OF THE DRAWINGS

The invention will be described with reference to the accompanying drawings, wherein like numbers reference like elements, and wherein.

DESCRIPTION OF THE EMBODIMENTS

Hereinafter, embodiments of the present invention will be described with reference to the drawings. In the embodiments described below, an electro-optical device of the present invention is applied to a liquid crystal device.

1: First Embodiment

First, an electro-optical device according to a first embodiment of the present invention will be described with reference to FIGS. 1 to 11.

<1-1: Overall Configuration of Electro-Optical Device>

Figure 1:
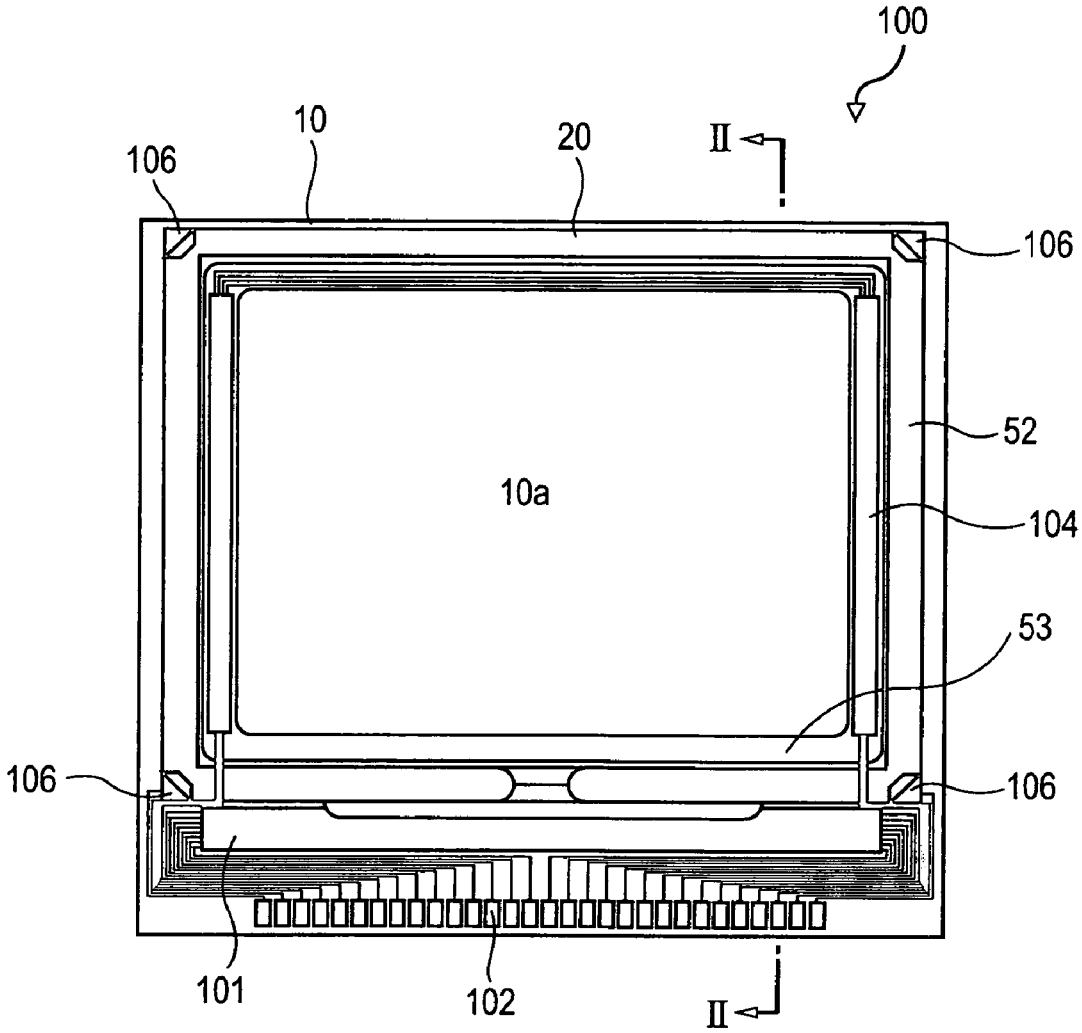
FIG. 1 is a plan view showing an overall configuration of a liquid crystal panel.
Figure 2:
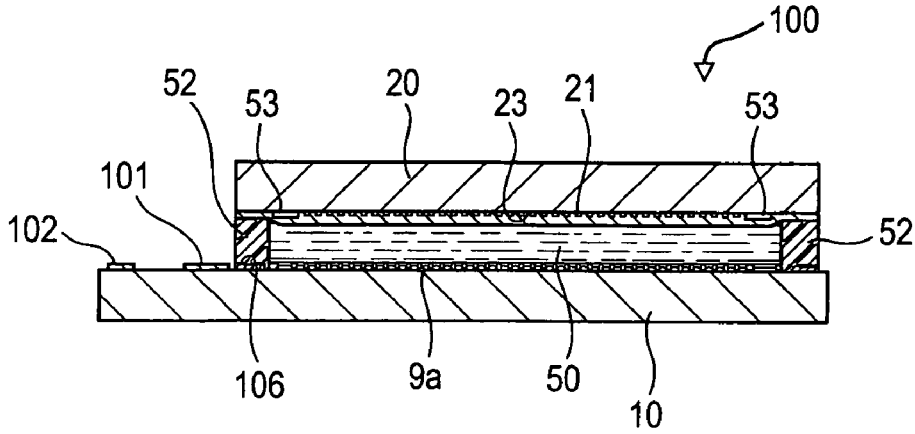
FIG. 2 is a cross-sectional view taken along the line II-II of FIG. 1.

The overall configuration of a liquid crystal panel, which is an example of an electro-optical panel, in the liquid crystal device serving as the electro-optical device of the invention will be described with reference to FIGS. 1 and 2. FIG. 1 is a schematic plan view of a liquid crystal panel, together with a TFT array substrate and respective parts formed thereon, as viewed from a counter substrate. FIG. 2 is a cross-sectional view taken along the line II-II of FIG. 1. Here, a TFT active matrix driving-type liquid crystal panel with built-in driving circuits is exemplified.

In FIGS. 1 and 2, in the liquid crystal panel 100 according to the present embodiment, the TFT array substrate 10 and the counter substrate 20 are disposed to face each other. Between the TFT array substrate 10 and the counter substrate 20, a liquid crystal layer 50 is sealed. The TFT array substrate 10 and the counter substrate 20 are bonded to each other by a sealing member 52 that is provided in a sealing region disposed in the periphery of an image display region 10*a*.

The sealing member 52 is made of, for example, ultraviolet curable resin, thermosetting resin, or the like so as to bond both substrates to each other. In a manufacturing process, the sealing member 52 is coated on the TFT array substrate 10 and is cured by ultraviolet irradiation, heating, or the like. Further, gap members, such as glass fibers, glass beads, or the like, are distributed in the sealing member 52 so as to maintain the space between the TFT array substrate 10 and the counter substrate 20 (inter-substrate gap) at a predetermined value.

Inside the sealing region, in which the sealing member 52 is disposed, a frame-shaped light-shielding film 53 that defines a frame region of the image display region 10*a* is provided on the counter substrate 20. However, the light-shielding film 53 may be partially or entirely formed as a built-in light-shielding film of the TFT array substrate 10 itself.

In a region disposed outside the sealing region, in which the sealing member 52 is disposed, from a peripheral region disposed in the periphery of the image display region 10*a*, a data line driving circuit 101 and external circuit connecting terminals 102 are provided along one side of the TFT array substrate 10. Further, a scanning line driving circuit 104 is provided along any one of two sides adjacent to the one side so as to be covered with the light-shielding film 53. Moreover, the scanning line driving circuits 104 may be provided along two sides adjacent to the one side of the TFT array substrate 10, on which the data line driving circuit 101 and the external circuit connecting terminals 102 are provided. In this case, the two scanning line driving circuits 104 are connected to each other via a plurality of wiring lines that are provided along the last side of the TFT array substrate 10.

Further, at four corner portions of the counter substrate 20, vertical connecting members 106 are disposed so as to function as vertical connecting terminals between both substrates. On the other hand, on the TFT array substrate 10, vertical connecting terminals are also provided in regions facing the corner portions. In such a manner, the TFT array substrate 10 and the counter substrate 20 are electrically connected to each other.

In FIG. 2, after pixel switching TFTs or wiring lines, such as the scanning lines, the data lines, and the like are formed on the TFT array substrate 10, an alignment film is formed on pixel electrodes 9*a*. On the other hand, on the counter substrate 20, in addition to a counter electrode 21, a lattice or strip-shaped light-shielding film 23 and an alignment film as an uppermost layer are formed on the counter substrate 20. Further, the liquid crystal layer 50 is made of liquid crystal in which one or several types of nematic liquid crystal are mixed and has a predetermined alignment state between the pair of alignment films.

Moreover, though not shown in FIGS. 1 and 2, on the TFT array substrate 10, in addition to the data line driving circuit 101, the scanning line driving circuit 104, and the like, a precharge circuit that supplies a precharge signal having a predetermined voltage level to the plurality of data lines prior to the image signals and a test circuit that tests for defects, the quality, and the like of the electro-optical device during manufacturing or at the time of shipping may be formed.

<1-2: Overall Configuration of Liquid Crystal Device>

Figure 3:
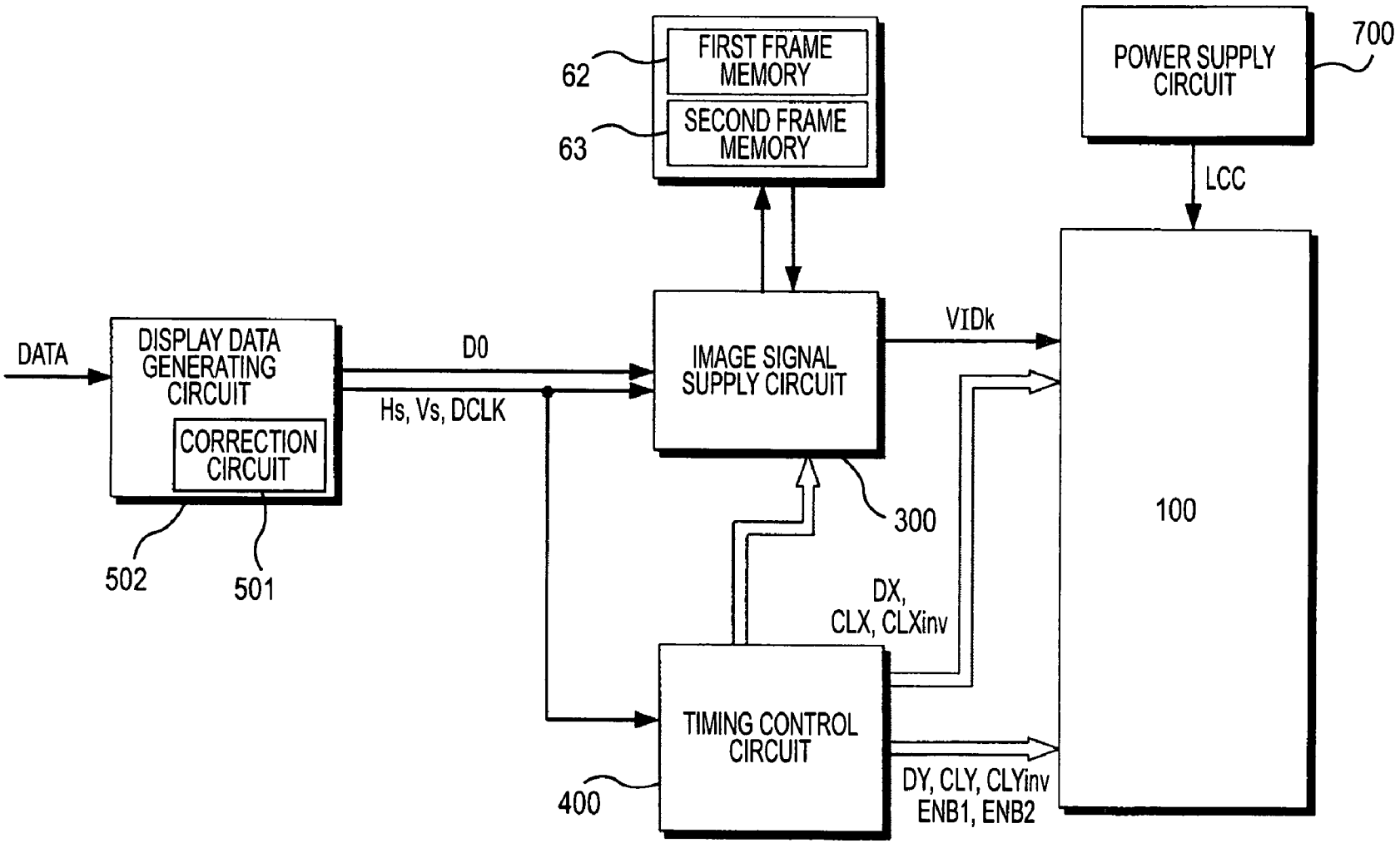
FIG. 3 is a block diagram showing an overall configuration of a liquid crystal device.
Figure 4:
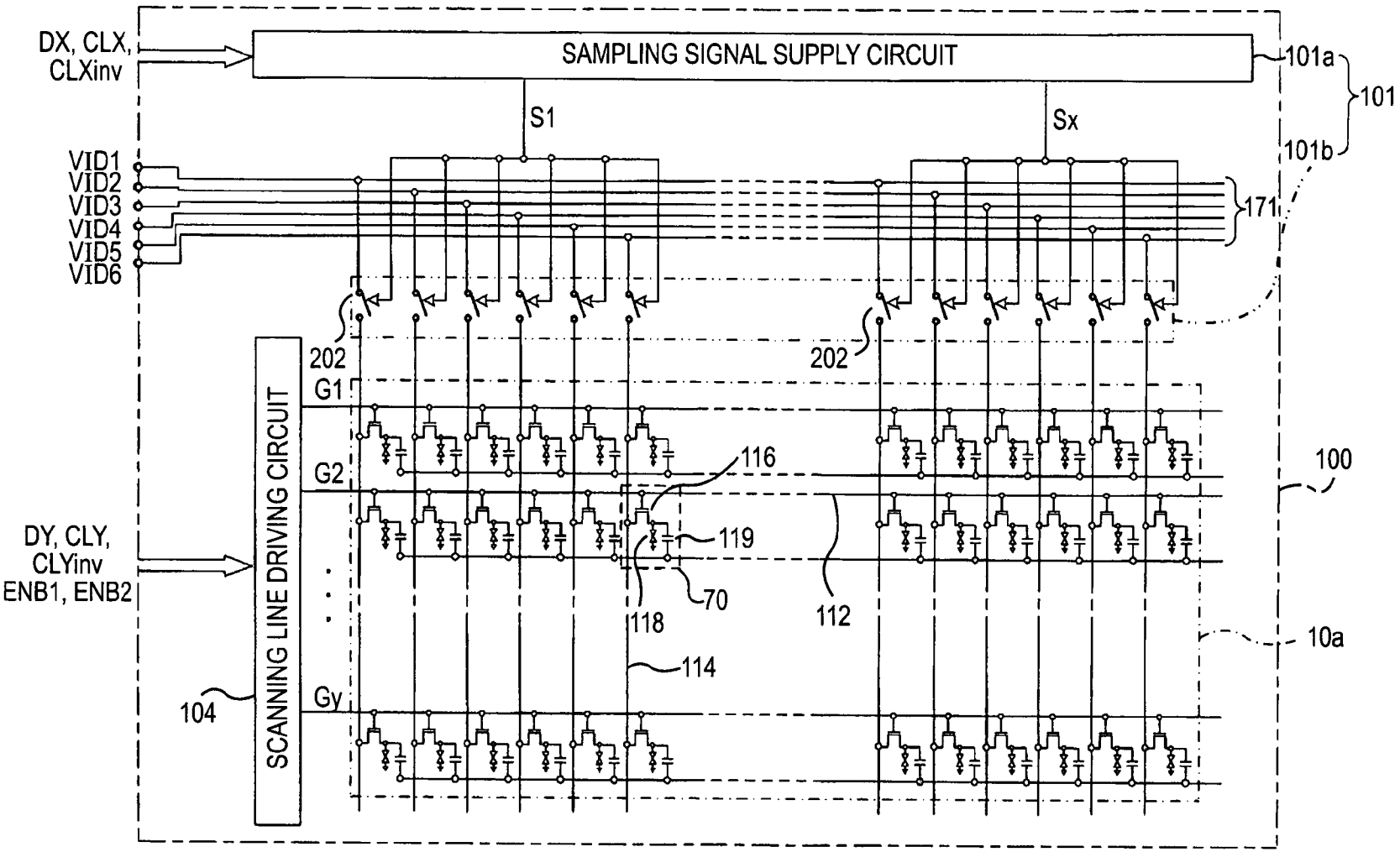
FIG. 4 is a block diagram showing an electrical configuration of a liquid crystal panel.

The overall configuration of a liquid crystal device will be described with reference to FIGS. 3 and 4. FIG. 3 is a block diagram showing an overall configuration of a liquid crystal device. FIG. 4 is a block diagram showing an electrical configuration of a liquid crystal panel.

As shown in FIG. 3, the liquid crystal device primarily has a liquid crystal panel 100, an image signal supply circuit 300, a first frame memory 62 and a second frame memory 63, a timing control circuit 400, a display data generating circuit 502, and a power supply circuit 700.

The display data generating circuit 502 generates horizontal synchronizing signals Hs and vertical synchronizing signals Vs, dot clocks DCLK, and display data D0 based on a source signal DATA, which is supplied from a video cassette recorder, a personal computer, or the like. Here, the display data generating circuit 502 performs the above-described down-conversion or up-conversion based on the source signal DATA or the signal processing for making the horizontal scanning period constant in a source signal, which is generated by a video cassette recorder or the like and has jitter in the time-axis direction. Therefore, display data D0 generated in such a manner may be outputted as incomplete display data in which the horizontal scanning period is not made constant at the end of each field period. Moreover, in order to adjust the deviation of the horizontal scanning period at the end of each field period from the constant period, a correction circuit 501 that adjusts the time length of one horizontal scanning period of one field period is included in the display data generating circuit 502, as described below.

The timing control circuit 400 is constituted to output various timing signals that are used in the respective parts. The timing control circuit 400 generates a Y clock signal CLY, an inverted Y clock signal CLYinv, an X clock signal CLX, an inverted X clock signal CLXinv, a Y start pulse DY, and an X start pulse DX based on the horizontal synchronizing signal Hs, the vertical synchronizing signal Vs, and the dot clock DCLK, which are supplied from the display data generating circuit 502. In addition, in the timing control circuit 400, two enable signals ENB1 and ENB2 for determining output timings of scanning signals described below are also generated.

Further, in the present embodiment, the 'image display supply circuit' according to the present invention in a broad sense primarily includes the data line driving circuit 101, in addition to the image signal supply circuit 300 and the first and second frame memories 62 and 63 shown in FIG. 3.

The image signal supply circuit 300 is supplied with the horizontal synchronizing signal Hs, the vertical synchronizing signal Vs, the dot clock DCLK, and display data D0 from the display data generating circuit 502. The image signal supply circuit 300 generates two field data signals based on display data D0, temporarily stores the two field data signals in one of the first frame memory 62 and the second frame memory 63 at a cycle at which a scanning signal is supplied to one scanning line, as described below, and reads one field data therefrom. Moreover, each of the two field data signals includes display data for displaying one screen.

Then, the image signal supply circuit 300 performs predetermined processing on one of the field data signals read. As an example of the predetermined processing, the image signal supply circuit 300 performs a serial-to-parallel conversion on one field data to generate N image signals, for example, 6 (N=6) image signals VID1 to VID6. In addition, the image signal supply circuit 300 inverts the polarity of the voltage of the generated image signal VIDk (where k=1, 2, . . . , 6) into positive and negative with respect to a predetermined reference potential v0 and outputs the image signal VIDk.

Further, the power supply circuit 700 supplies common power having a predetermined common potential LCC to the counter electrode 21 shown in FIG. 2. In the present embodiment, the counter electrode 21 is formed to face a plurality of pixel electrodes 9*a* on the lower surface of the counter substrate 20 shown in FIG. 2.

Next, the electrical configuration of the liquid crystal panel 100 will be described.

As shown in FIG. 2, in the liquid crystal panel 100, an internal driving circuit having the scanning line driving circuit 104 and the data line driving circuit 101 is provided in the peripheral region of the TFT array substrate 10.

The scanning line driving circuit 104, the details of which will be described, is supplied with the Y clock signal CLY, the inverted Y clock signal CLYinv, and the Y start pulse DY so as to basically perform a line-sequential horizontal scanning. In addition, the scanning line driving circuit 104 outputs the scanning signals G1, G2, . . . , Gy in a sequence described below at the timing based on the enable signals ENB1 and ENB2 supplied thereto.

In the present embodiment, the data line driving circuit 101 primarily includes a sampling signal supply circuit 101*a* and a sampling circuit 101*b*. The sampling signal supply circuit 101*a* is supplied with the X clock signal CLX, the inverted X clock signal CLXinv, and the X start pulse DX. If the X start pulse DX is inputted, the sampling signal supply circuit 101*a* sequentially generates and outputs sampling signals S1, . . . , Sx at the timing based on the X clock signal CLX and the inverted X clock signal XCLXinv.

The sampling circuit 101*b* has a plurality of sampling switches 202 which are formed with a single-channel TFT of a P-channel-type or an N-channel-type or a complementary TFT.

In addition, the liquid crystal panel 100 has data lines 114 and scanning lines 112, which are wired vertically and horizontally, in the image display region 10*a* occupying the center of the TFT array substrate. Further, at the respective pixel units 70 corresponding to intersections of the data lines 114 and the scanning lines 112, the pixel electrodes 9*a* of liquid crystal elements 118 arranged in a matrix shape and TFTs 116 that control switching of the pixel electrodes 9*a* are provided.

Moreover, in the present embodiment, in particular, the total number of scanning lines 112 is set to y (where y is a natural number of 2 more) and the total number of data lines 114 is set to x (where x is a natural number of 2 more).

As described above, for example, the image signals VID1 to VID6 expanded into 6 sampling signals through the serial-to-parallel conversion are supplied to the liquid crystal panel 100 via image signal lines 171.

In the sampling circuit 101*b*, N sampling switches 202, for example, 6 sampling switches 202 in the present embodiment, constitute one group and the sampling signal Si (where i=1, 2, . . . , x) is inputted to one group of the sampling switches 202. One group of the sampling switches 202 samples the image signal VIDk according to sampling signal Si and supplies the sampled image signal VIDk to one group of the data lines 114. Here, N data lines 114, for example, 6 data lines in the present embodiment, constitute one group. That is, one group of the data lines 114 is electrically connected to the image signal lines 171 via one group of the sampling switches 202. Accordingly, in the present embodiment, the x data lines 114 are driven in groups, and thus a driving frequency is suppressed.

In FIG. 4, focusing on the configuration of one pixel unit 70, a source electrode of the TFT 116 is electrically connected to the data line 114 to which the image signal VIDk is supplied, and a gate electrode of the TFT 116 is electrically connected to the scanning line 112 to which the scanning signal Gj (where j=1, 2, 3, . . . , y) is supplied. A drain electrode of the TFT 116 is connected to the pixel electrode 9*a* of the liquid crystal element 118. Here, in each pixel unit 70, the liquid crystal element 118 has the pixel electrode 9*a* and the counter electrode 21 with liquid crystal interposed therebetween. Therefore, the respective pixel units 70 are disposed in a matrix shape to correspond to the intersections of the scanning lines 112 and the data lines 114.

When the TFT 116 is turned on for a constant time, the pixel electrode 9*a* of the liquid crystal element 118 is supplied with the image signal VIDk from the data line 114 at a predetermined timing. Accordingly, a voltage according to potentials on the pixel electrode 9*a* and the counter electrode 21 is applied to the liquid crystal element 118. Liquid crystal changes its alignment or order of the molecular groups according to the level of voltage applied to provide light modulation and a grayscale display. In a normally white mode, transmittance of incident light is decreased according to the voltage applied to each pixel unit. In a normally black mode, transmittance of incident light is increased according to the voltage applied to the pixel unit. As a result, light having a contrast according to the image signal VIDk is emitted from the liquid crystal panel 100 as a whole.

Here, in order to prevent leakage of the held image signal, a storage capacitor 119 is added in parallel with the liquid crystal element 118. For example, the voltage of the pixel electrode 9*a* is held by the storage capacitor 70 for a longer time, namely, for a period as much as three orders of magnitude longer than the time for which the source voltage is applied. Accordingly, the maintenance characteristic is enhanced, such that a high contrast ratio can be realized.

<1-3: Operation of Electro-Optical Device>

Next, the operation of the liquid crystal device will be described with reference to FIGS. 5 to 10, in addition to FIGS. 1 to 4.

Figure 5:
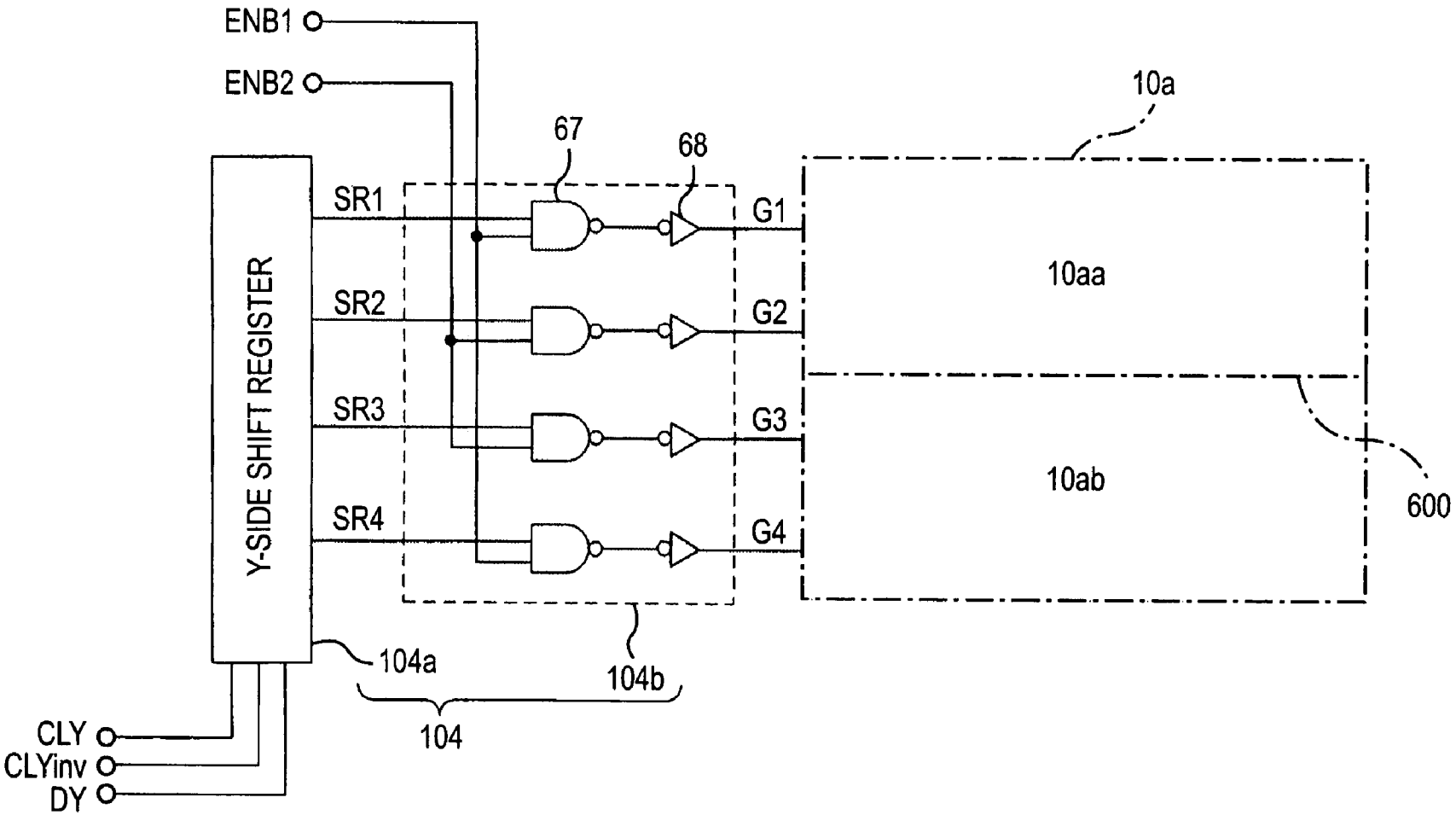
FIG. 5 is a diagram showing an example of a configuration of a scanning line driving circuit.

First, the detailed configuration of the scanning line driving circuit 104 showing FIG. 1 or 4 will be described with reference to FIG. 5. FIG. 5 shows an example of the configuration of the scanning line driving circuit 104.

Hereinafter, for simplicity of explanation, as shown in FIG. 5, it is assumed that the total number m of the scanning lines 112 is four, and a first partial region 10*aa* and a second partial region 10*ab* obtained by bisecting the image display region 10*a* by a division line 600 along the scanning lines 112 are subjected to region scanning. That is, in a case in which the total number n of the plurality of partial regions is two, region scanning will be described.

In FIG. 5, the scanning line driving circuit 104 primarily includes a Y-side shift register 104*a*, to which the Y clock signal CLY, the inverted Y clock signal CLYinv, and the Y start pulse DY are inputted, and an output control unit 104*b* that has four logical circuits corresponding to four scanning lines 112. One logical circuit includes, for example, a NAND circuit 67 and a NOT circuit 68. The NAND circuit 67 is supplied with one output signal from the Y-side shift register 104*a* and any one of two enable signals ENB1 and ENB2. Further, output signals of the respective NAND circuits 67 are outputted to the corresponding scanning lines 112 via the NOT circuits 68 as the scanning signals G1, G2, G3, and G4.

Figure 6:
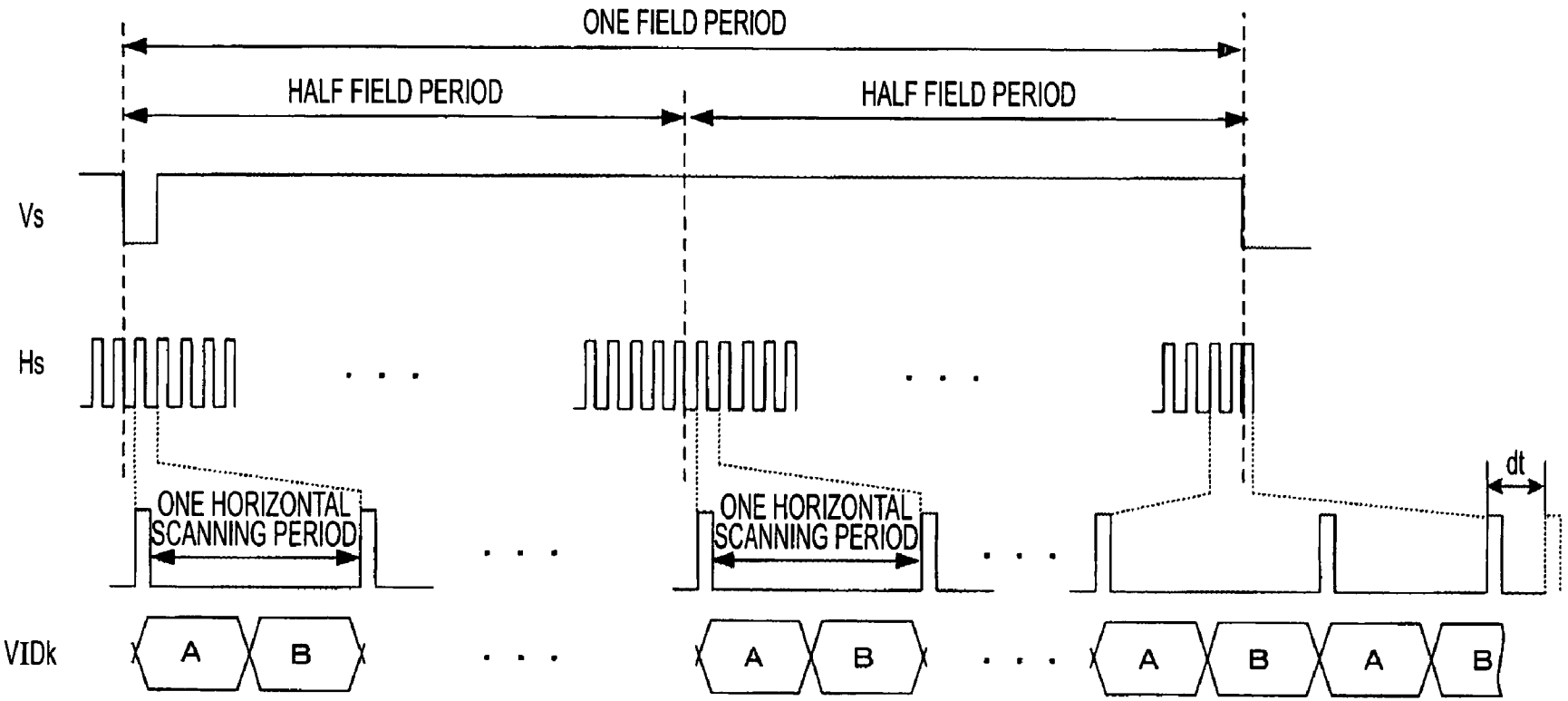
FIG. 6 is a diagram illustrating the generation of image signals in an image signal supply circuit.
Figure 7:
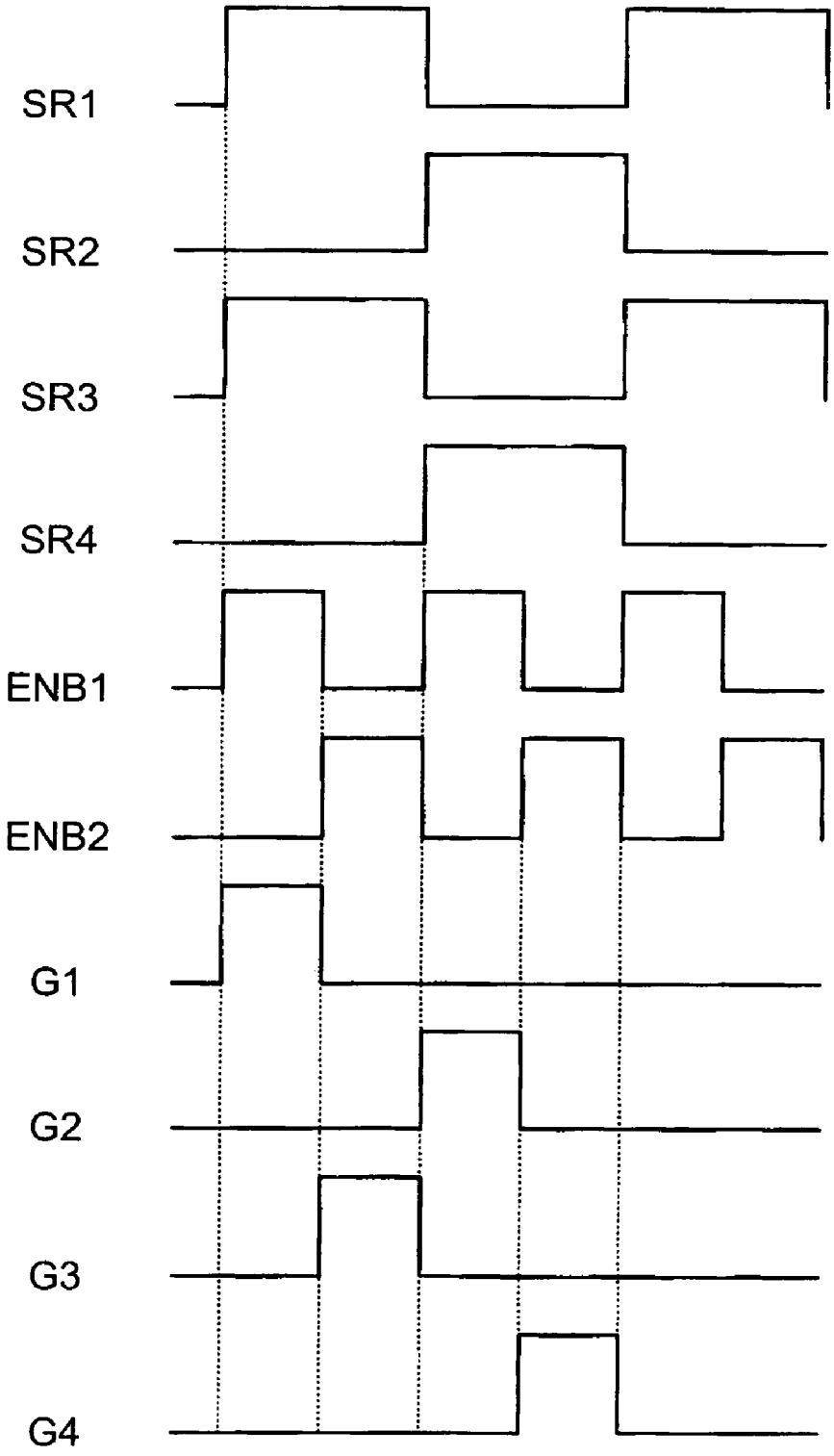
FIG. 7 is a timing chart illustrating an operation of a scanning line driving circuit.
Figure 8:
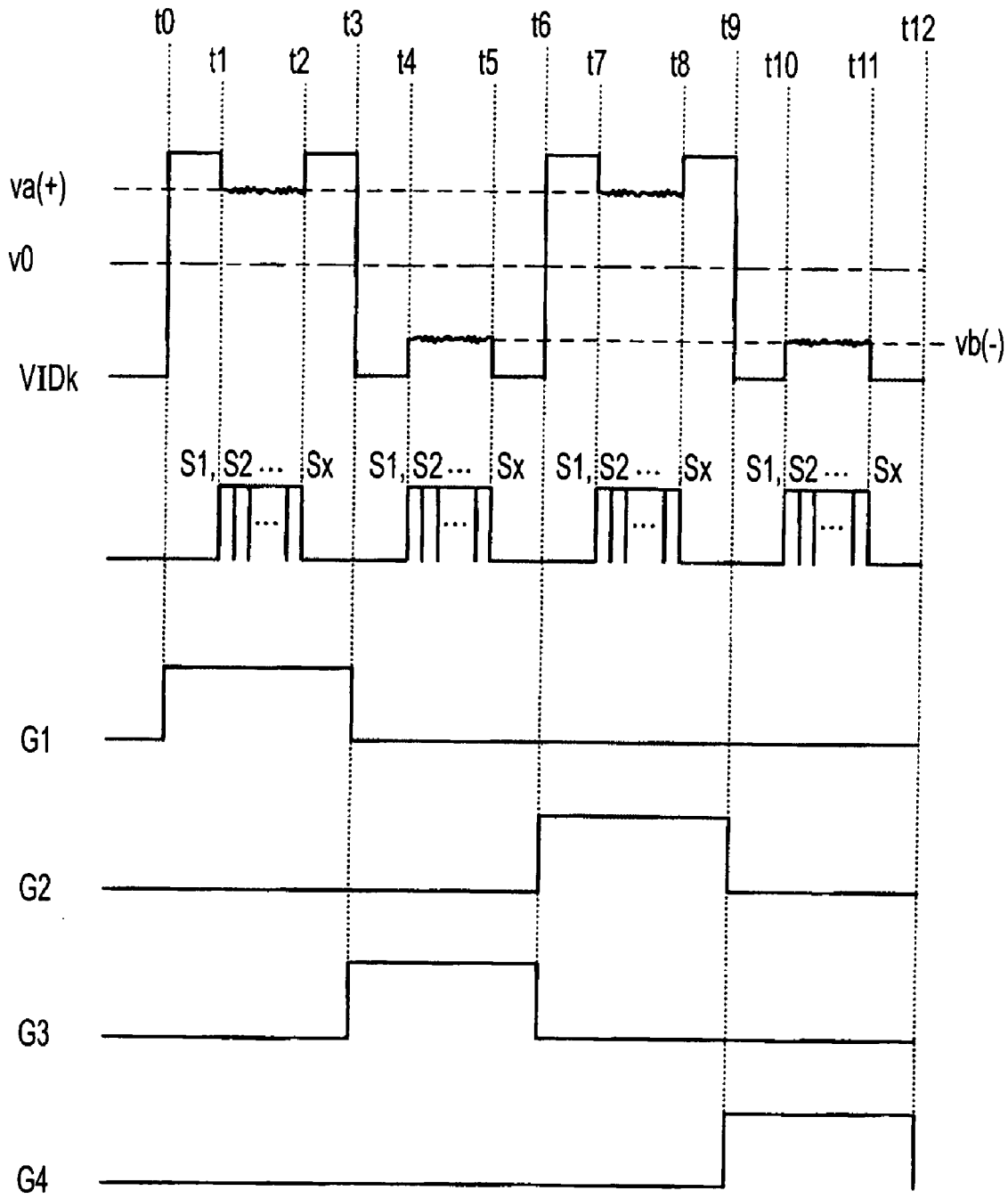
FIG. 8 is a timing chart illustrating time-lapse changes of various signals for driving respective data lines and respective scanning lines.
Figure 9:
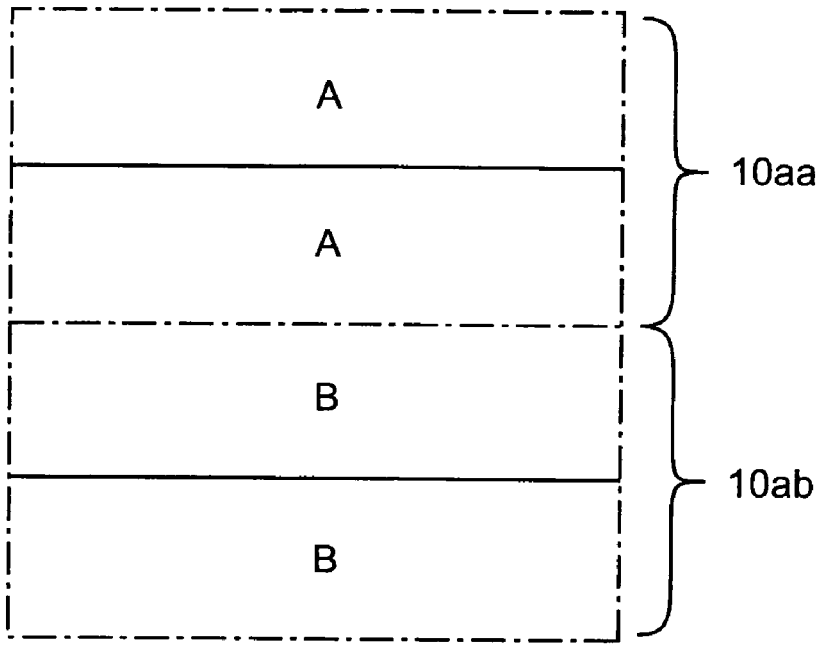
FIG. 9 is a diagram conceptually illustrating region scanning in the present embodiment.

Next, region scanning to be performed on the first partial region 10*aa* and the second partial region 10*ab* will be described in detail with reference to FIGS. 6 to 9, in addition to FIGS. 1 to 5. FIG. 6 is a diagram illustrating the generation of the image signal VIDk in the image signal supply circuit 300. FIG. 7 is a timing chart illustrating the operation of the scanning line driving circuit 104. FIG. 8 is a timing chart showing time-lapse changes of various signals for driving the respective data lines 114 and the respective scanning lines 112. Further, FIG. 9 is a diagram conceptually illustrating region scanning in the present embodiment.

In FIG. 6, the image signal supply circuit 300 generates the image signal VIDk for displaying one screen on the image display region 10*a* based on one field data for each half field period in one field period, which is defined by the vertical synchronizing signal Vs. The generation process of the image signal VIDk is as follows. Moreover, FIG. 6 is a diagram illustrating the generation of the image signal VIDk in a case in which the total number n of the plurality of partial regions is two and the total number m of the scanning lines 112 is not limited to four. The image signal supply circuit 300 adjusts the voltage of the image signal VIDk to a first display voltage defined by a reference potential v0 and a positive display potential va(+) with respect to the reference potential v0 in a first half horizontal scanning period of one horizontal scanning period, which is defined by the horizontal synchronizing signal Hs. Further, the image signal supply circuit 300 adjusts the voltage of the image signal VIDk to a second display voltage defined by the reference potential v0 and a negative display potential vb(−) with respect to the reference potential v0 in a second half horizontal scanning period of one horizontal scanning period. In FIG. 6, it is assumed that the image signal VIDk adjusted to the first display voltage is an image signal A and the image signal VIDk adjusted to the second display voltage is an image signal B. Moreover, the polarities of the image signal A and the image signal B are respectively inverted with respect to the reference potential v0 for each half horizontal scanning period.

Then, in the image signal supply circuit 300, after the supply of the image signal B ends in the last horizontal scanning period for each field period, the image signal VIDk for defining a vertical retrace period is supplied.

Next, region scanning in the half field period will be described with reference to FIGS. 7 and 8.

In the half field period, the scanning signals G1, G2, G3, and G4 are supplied alternately to the first partial region 10*aa* and the second partial region 10*ab* from the scanning line driving circuit 104 shown in FIG. 5. Further, in the first partial region 10*aa* and the second partial region 10*ab*, the scanning signals G1 and G2 or G3 and G4 are supplied sequentially to the scanning lines 112 from the top of the corresponding partial region 10*aa* or 10*ab* to the bottom thereof along the arrangement direction of the scanning lines 112.

As shown in FIG. 7, output signals SR1 to SR4 from the Y-side shift register 104*a* are outputted to the respective scanning lines 112 at the same timing as if the first partial region 10*aa* and the second partial region 10*ab* were simultaneously subjected to horizontal scanning. That is, in the first partial region 10*aa* and the second partial region 10*ab*, the output signals SR1 and SR3 corresponding to the scanning line 112, to which the scanning signal Gj is supplied first of all, and the output signals SR2 and SR4 corresponding to the scanning line 112, to which the scanning signal Gj is supplied secondly, are sequentially outputted for each horizontal scanning period. Moreover, since it is assumed that the total number m of the scanning lines is four, for this case only, the output signals SR1 and SR3 and the output signals SR2 and SR4 are outputted alternately for each horizontal scanning period. On the other hand, the enable signals ENB1 and ENB2 rise from the low level to the high level alternately for each half horizontal scanning period. Accordingly, among the output signals SR1 to SR4, one outputted at the time of the rising edge of any one of the enable signals ENB1 and ENB2 is selected by the logical circuit and is outputted to the scanning line 112 as the scanning signal Gj. As a result, as shown in FIG. 7, the scanning signals G1 to G4 are sequentially outputted from the scanning line driving circuit 104 for each half horizontal scanning period.

In FIG. 8, if the half field period starts at the time t0, in the first partial region 10*aa*, the first scanning signal G1 of the first partial region 10*aa* is supplied to the corresponding first scanning line 112 from the scanning line driving circuit 104.

Next, in an image signal supply period from the time t1 to the time t2, the image signal A is supplied from the image signal supply circuit 300. Further, in the image signal supply period, the sampling signals S1, S2, . . . , Sn, which are the output signals of the shift register, are sequentially supplied from the sampling signal supply circuit 101*a*, and the sampling switches 202 in one group in the sampling circuit 101*b* are sequentially turned on. Then, the image signal A is supplied to the data lines 114 via the sampling switches 202 to be turned on and are supplied to the pixel units 70 corresponding to the first scanning line 112 via the data lines 114.

Next, at the time t3, in the second partial region 10*ab*, the first scanning signal G3 (according to the output sequence from the scanning line driving circuit 104, the second scanning signal) of the second partial region 10*ab* is supplied to the corresponding second scanning line 112 from the scanning line driving circuit 104.

Next, in an image signal supply period from the time t4 to the time t5, the image signal B is supplied from the image signal supply circuit 300. After the sampling switches 202 in one group are sequentially turned on according to the sampling signals S1, S2, . . . , Sn supplied from the sampling signal supply circuit 101*a*, the image signal B is supplied to the data lines 114 via the sampling switches 202 to be turned on. In addition, the image signal B is supplied to the pixel units 70 corresponding to the second scanning line 112 via the data lines 114.

Next, at the time t6, in the first partial region 10*aa*, the second scanning signal G2 (the third scanning signal according to the output sequence from the scanning line driving circuit 104) of the first partial region 10*aa* is supplied to the corresponding third scanning line 112 from the scanning line driving circuit 104. Then, in an image signal supply period from the time t7 to the time t8, like the pixel units 70 corresponding to the first scanning line 112, the image signal A is supplied to the pixel units 70 corresponding to the third scanning line 112.

Subsequently, at the time t9, in the second partial region 10*ab*, the second scanning signal G4 (the fourth scanning signal according to the output sequence from the scanning line driving circuit 104) of the second partial region 10*ab* is supplied to the corresponding fourth scanning line 112 from the scanning line driving circuit 104. In an image signal supply period from the time t10 to the time t11, like the pixel units 70 corresponding to the second scanning line 112, the image signal B is supplied to the pixel units 70 corresponding to the fourth scanning line 112.

Next, at the time t12, the half field period ends. As described above, in FIG. 9, in each horizontal scanning period of the half field period, the image signal A is written into the pixel units 70 corresponding to the scanning line 112 of the first partial region 10*aa* in the first half horizontal scanning period of one horizontal scanning period. Then, the image signal B is written into the pixel units 70 corresponding to the scanning line 112 of the second partial region 10*ab* in the second half horizontal scanning period of one horizontal scanning period. Further, for each half field period, one screen is displayed on the image display region 10*a* and the image signal supply circuit 300 inverts the polarities of the image signal A and the image signal B. Accordingly, the first partial region 10*aa* and the second partial region 10*ab* are subjected to surface inversion driving.

Returning to FIG. 6, in the last horizontal scanning period of one field period, the last scanning signal G4 is supplied to the last scanning line 112, that is, the fourth scanning line 112 of the second partial region 10*ab* in the second half horizontal scanning period of the last horizontal scanning period. Then, the image signal B is supplied from the image signal supply circuit 300 and the pixel units 70 corresponding to the fourth scanning signal 112 are subjected to horizontal scanning. If horizontal scanning of the pixel units 70 corresponding to the fourth scanning line 112 ends, the image signal VIDk, which defines the vertical retrace period, is outputted from the image signal supply circuit 300.

Figure 10:
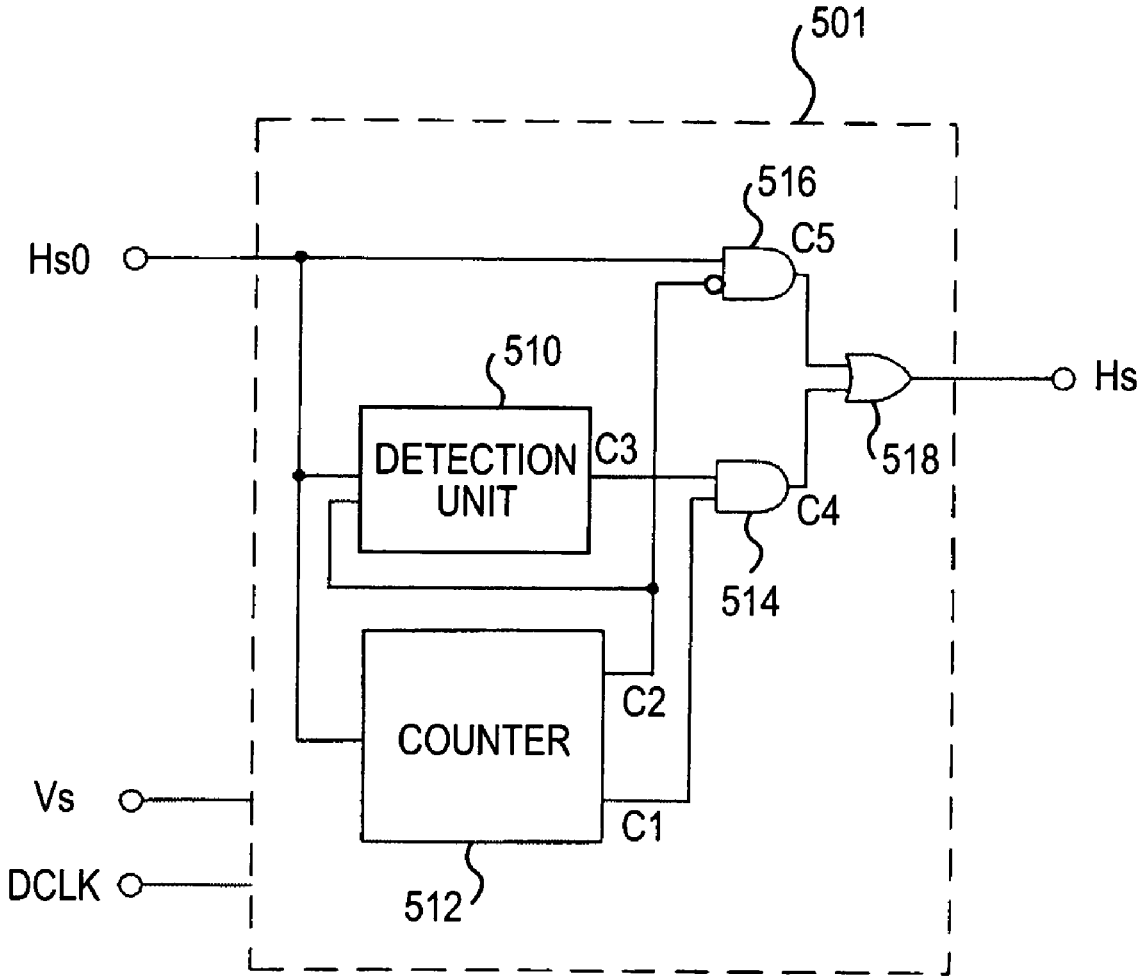
FIG. 10 is a block diagram showing a configuration of a correction circuit.
Figure 11:
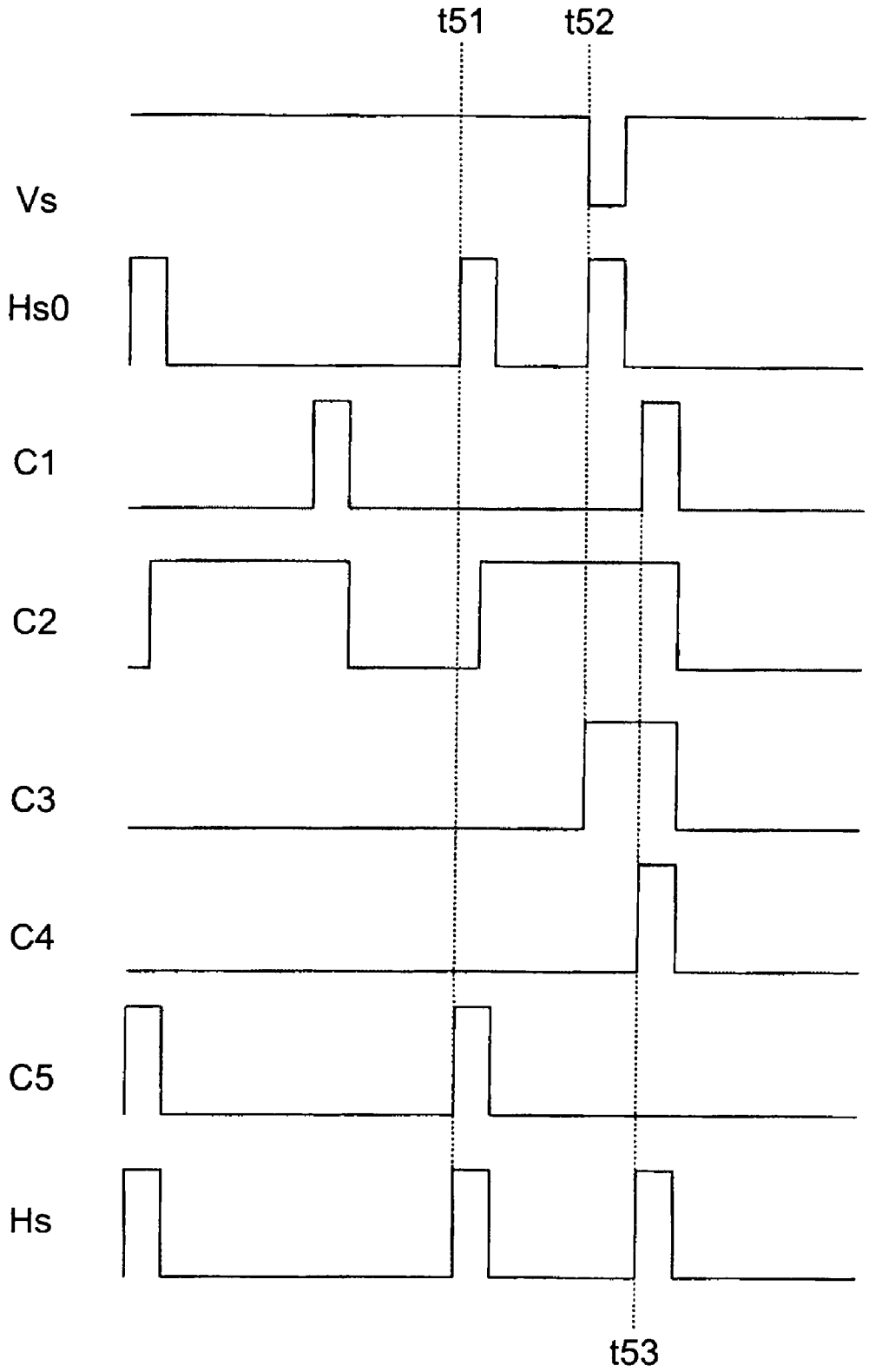
FIG. 11 is a flowchart illustrating an operation of a correction circuit.

In the present embodiment, the display data generating circuit 502 includes the correction circuit 501 that adjusts the time length of the last horizontal scanning period of one field period. Examples of the configuration and the operation of the correction circuit 501 will be described with reference to FIGS. 10 and 11. FIG. 10 is a block diagram showing the configuration of the correction circuit 501. FIG. 11 is a flowchart illustrating the operation of the correction circuit 501.

In FIG. 10, the correction circuit 501 includes a counter 512, a detection unit 510, and three logical circuits 514, 516, and 518.

The correction circuit 501 is supplied with the horizontal synchronizing signal Hs0, the vertical synchronizing signal Vs, and the dot clock DCLK, which are generated by the display data generating circuit 502 based on the source signal DATA. The display data generating circuit 502 generates the horizontal synchronizing signal Hs0 such that two continuous horizontal synchronizing signals Hs0 on the time axis have a predetermined interval. Accordingly, the respective horizontal scanning periods in one field period are made constant. However, when the total number of horizontal synchronizing signals Hs0 is not an integer multiple of the total number of vertical synchronizing signals Vs, the last horizontal scanning period of one field period is inconstant on the time axis. That is, two horizontal synchronizing signals Hs0 that are continuous on the time axis and are generated by the display data generating circuit 502 do not necessarily have the predetermined value.

The counter 512 counts whether or not the interval of the input timings of two horizontal synchronizing signals Hs0 that are inputted continuously on the time axis is a half of the time length of one horizontal scanning period, which is the constant period, that is, has the same length as that of the half horizontal scanning period, and, if the interval is equal to or larger than the length of the half horizontal scanning period, outputs an output signal C1. Moreover, the interval of two output signals C1, which are continuous on the time axis, has the same length as that of the one horizontal scanning period, which is the constant period.

On the other hand, an output signal C2 outputted from the counter 512 rises from the low level to the high level at the input timing of the horizontal synchronizing signal Hs0 and falls from the high level to the low level at the output timing of the output signal C1. The high level of the output signal C2 has the same length as a half of the length of one horizontal scanning period, which is the constant period, that is, that of the half horizontal scanning period, on the time axis.

When detecting that the interval of the input timings of two horizontal synchronizing signals Hs0, which are continuous on the time axis, is made to be shorter than half of the length of one horizontal scanning period, which is the constant period, that is, the length of the half horizontal scanning period, based on the output signal C2, the detection unit 510 outputs a detection signal C3 with respect to the horizontal synchronizing signal Hs0, which is inputted after, between two horizontal synchronizing signals Hs0.

The logical circuit 514 calculates a logical product (AND) of the output signal C1 and the detection signal C3 and outputs an output signal C4. Further, when the output signal C2 is at the low level and the horizontal synchronizing signal Hs0 is inputted, the logical circuit 516 outputs an output signal C5. In addition, the logical circuit 518 calculates a logical sum (OR) of two output signals C4 and C5 and outputs a horizontal synchronizing signal Hs having a corrected output timing.

Next, the operation of the correction circuit 501 will be described with reference to FIG. 11. Referring to FIG. 11, at the time t51, the last horizontal synchronizing signal Hs0 of one field period is inputted to the correction circuit 501. Here, the time interval between the input timing of the last horizontal synchronizing signal Hs0 and the input timing of the horizontal synchronizing signal Hs0, which is inputted continuously prior to the last horizontal synchronizing signal Hs0, has the same length as that of the one horizontal scanning period, which is the constant period, and has a length equal to or larger than the half horizontal scanning period. Accordingly, the output signal C1 and the output signal C2 are outputted from the counter 510. Further, the output signal C5 is outputted from the logical circuit 516, and the horizontal synchronizing signal Hs is outputted from the logical circuit 518. Then, the last horizontal synchronizing signal Hs of one field period is outputted from the display data generating circuit 502.

Subsequently, at the time t52, one field period ends and a next horizontal synchronizing signal Hs0 subsequent to the last horizontal synchronizing signal Hs0 is inputted to the correction circuit 501. The interval between the input timing of the next horizontal synchronizing signal Hs0 and the input timing of the last horizontal synchronizing signal Hs0 is made to be shorter than the length of the half horizontal scanning period on the time axis. Since the next horizontal synchronizing signal Hs0 is inputted when the output signal C2 is the high level, the detection unit 510 outputs the detection signal C3. Further, at the time t52, the output signal C5 is not outputted from the logical circuit 516. In addition, at the time t52, since the output signal C1 is not outputted, the output signal C4 is not outputted from the logical circuit 514. For this reason, the horizontal synchronizing signal Hs is not outputted from the logical circuit 518.

Subsequently, at the time t53, the output signal C1 is outputted and the detection signal C3 becomes the high level. Thus, the output signal C4 is outputted from the logical circuit 514. Then, the horizontal synchronizing signal Hs is outputted from the logical circuit 518.

Here, the interval of the last horizontal scanning period of one field period, which is defined by the output timing of the horizontal synchronizing signal Hs outputted at the time t51 and the output timing of the horizontal synchronizing signal Hs outputted at the time t53, is corrected to the same length as that of the half horizontal scanning period.

Returning to FIG. 6, basically, the last horizontal scanning period of one field period is preferably the constant period. However, even when the last horizontal scanning period is shorter than the constant period, the last horizontal scanning period is corrected to the same length as that of the half horizontal scanning period by the correction circuit 501. Accordingly, the deviation dt from the constant period of the last horizontal scanning period is adjusted to the same length as that of the half horizontal scanning period. Moreover, in the present embodiment, the deviation dt from the constant period of the last horizontal scanning period may be adjusted to be shorter than the half horizontal scanning period by the correction circuit 501.

In this case, as shown in FIG. 6, the write operation of the image signal B to the pixel units 70 corresponding to the fourth scanning line 112 may not be normally performed. However, in this case, even when the image signal B is made incomplete due to the inconstant horizontal scanning period, and is thus not normally written, since the pixel units 70 to which incomplete image signals are written are disposed at an edge of the image display region 10*a*, the display failure does not occur to the extent that it can be viewed on the display screen. Further, if the last horizontal scanning period ends in the vertical retrace period, the write operation of the image signal to the pixel units 70 in the image display region 10*a* is normally performed, such that the display screen is not influenced.

Therefore, according to the present embodiment described above, the inconsistency generated when display is performed by region scanning based on incomplete display data D0 in the last horizontal scanning period of each field period does not actually appear on the display screen, thereby enhancing the image quality. Further, the degree of freedom for the signal processing in the display data generating circuit 502 can be increased, and also the margin for the time deviation according to the last horizontal scanning period of each field period can be made relatively large, thereby achieving superior practicability.

2: Second Embodiment

Next, an electro-optical device according to a second embodiment of the invention will be described. In the second embodiment, a liquid crystal device serving as an electro-optical device has a different configuration from the liquid crystal device in the first embodiment. Accordingly, hereinafter, the configuration and operation of the liquid crystal device will be described with reference to FIGS. 12 to 14, laying emphasis on different parts from the first embodiment. Moreover, the same parts as those in the first embodiment are represented by the same reference numerals and the descriptions thereof will be omitted.

Figure 12:
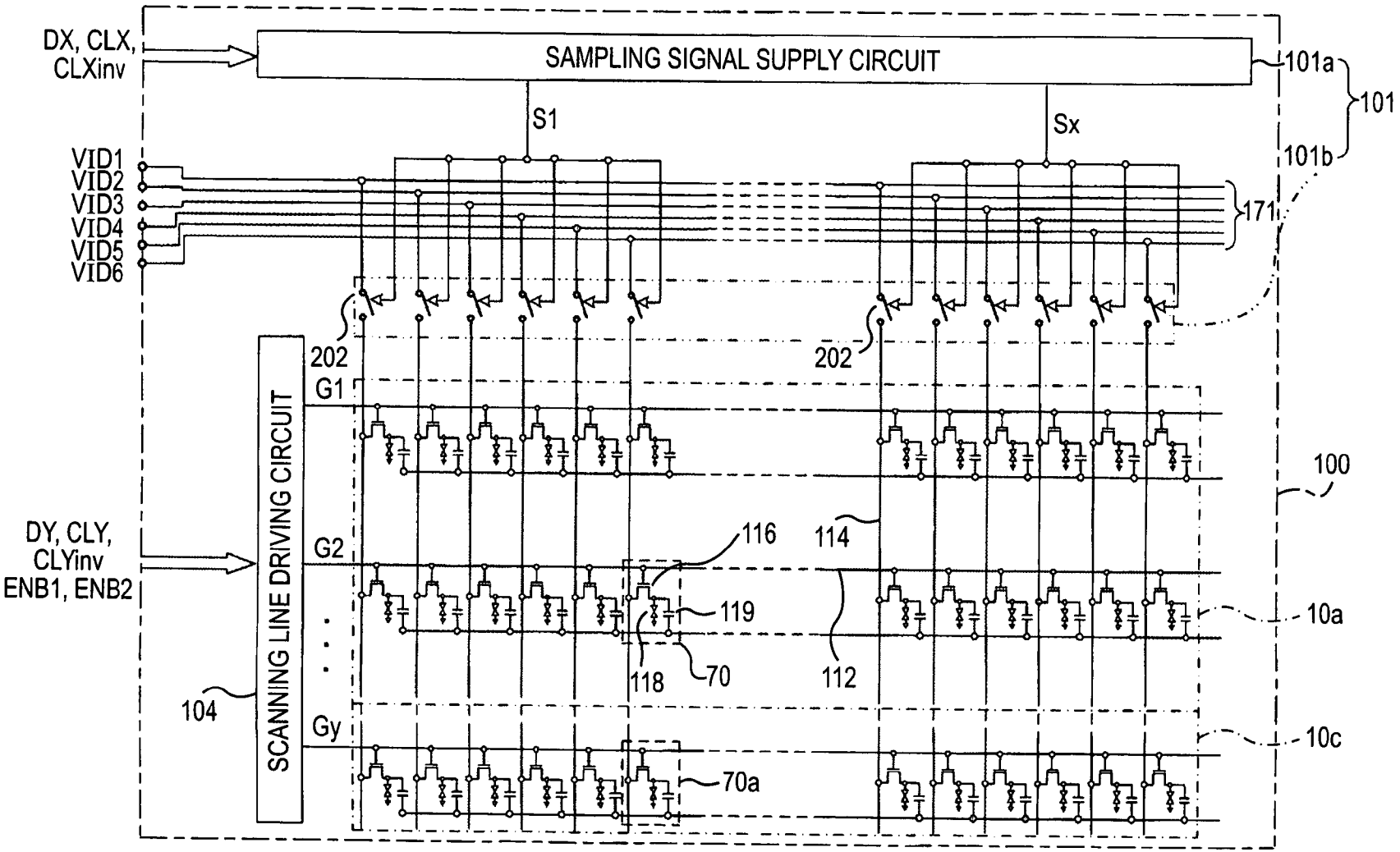
FIG. 12 is a block diagram showing an electrical configuration of a liquid crystal panel in a second embodiment.

First, the configuration of a liquid crystal panel of the second embodiment will be described with reference to FIG. 12. FIG. 12 is a block diagram showing the electrical configuration of the liquid crystal panel in the second embodiment.

As shown in FIG. 12, in the image display region 10*a* of the liquid crystal panel 100, a dummy region 10*c* is provided. In the dummy region 10*c*, dummy pixel units 70*a*, which do not contribute to image display, are formed to correspond to the intersections of the scanning lines 112 and the data lines 114. The configuration of each of the dummy pixel units 70*a* is the same as the configuration of the pixel unit 70 in the image display region 10*a*. Moreover, since the dummy pixel units 70*a* do not contribute to the image display, the liquid crystal elements 118 or the driving elements, such as the TFTs 116 and the like, may be formed or may not be formed.

Figure 13:
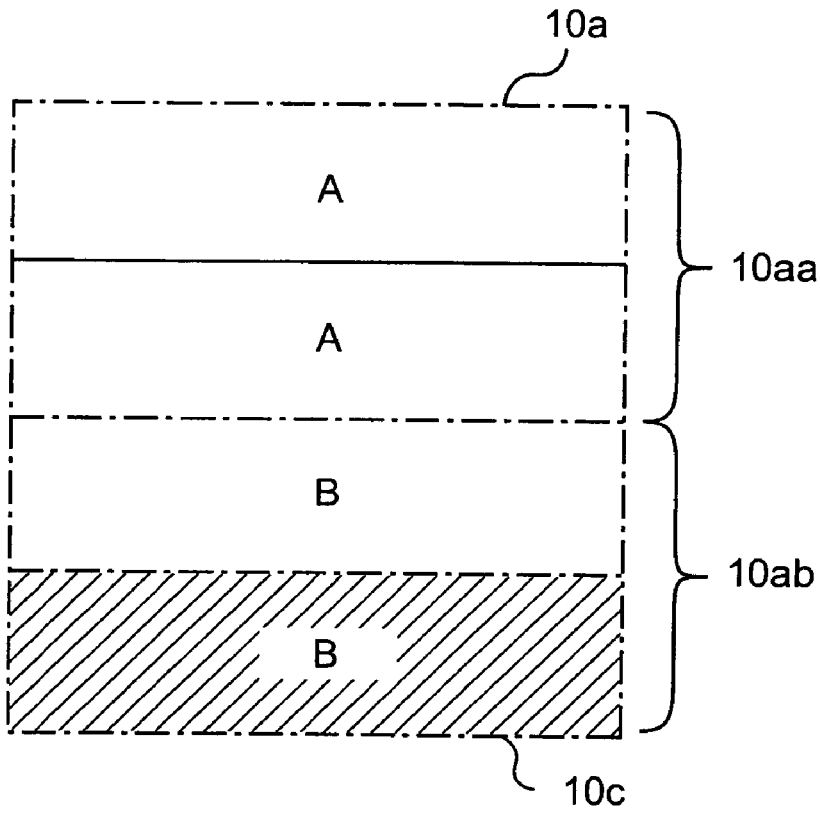
FIG. 13 is a diagram conceptually illustrating region scanning in the second embodiment.

Next, the operation of the liquid crystal device in the second embodiment will be described with reference to FIG. 13, in addition to FIG. 12. FIG. 13 is a diagram conceptually illustrating region scanning in the second embodiment. Moreover, in the second embodiment, the overall configuration of the liquid crystal device is the same as that in the first embodiment. Accordingly, the overall configuration of the liquid crystal device will be described with reference to FIG. 3.

Hereinafter, for simplicity of explanation, it is assumed that the total number m of the scanning lines 112 is four. In this case, like FIG. 5, the first partial region 10*aa* and the second partial region 10*ab*, which are obtained by bisecting the image display region 10*a* by the division line along the scanning lines 112 are subjected to region scanning. The second partial region 10*ab* includes the dummy region 10*c*.

Next, region scanning in the half field period will be described with reference to FIG. 13.

As shown in FIG. 13, in each horizontal scanning period of the half field period, the pixel units 70 corresponding to the scanning line 112 of the first partial region 10*aa* are subjected to horizontal scanning in the first half horizontal scanning period of one horizontal scanning period and the image signal A is written into these pixel units 70. Then, the pixel units 70 corresponding to the scanning line 112 of the second partial region 10*ab* are subjected to horizontal scanning in the second half horizontal scanning period of one horizontal scanning period and the image signal B is written into these pixel units 70. In such a manner, after the image signal A is written into the pixel units 70 corresponding to the first scanning line 112 in the image display region 10*a* and the image signal B is written into the pixel units 70 corresponding to the second scanning line 112 in the image display region 10*a*, in the last horizontal scanning period of the half field period, the image signal A is written into the pixel units 70 corresponding to the last scanning line 112 of the first partial region 10*aa*, that is, the third scanning line 112 in the image display region 10*a* in the first half horizontal scanning period. Then, in the last horizontal scanning period of the half field period, the image signal B is written into the dummy pixel units 70*a* corresponding to the fourth scanning line 112 in the second half horizontal scanning period.

Here, in the display data generating circuit 502, the time length of the last horizontal scanning period of one field period is adjusted by the correction circuit 501. Accordingly, the deviation dt from the constant period of the last horizontal scanning period is adjusted to be equal to or shorter than that of the half horizontal scanning period. In the last horizontal scanning period, the image signal B is written into the dummy pixel units 70*a* in the second half horizontal scanning period of one horizontal scanning period, and thus image display by the respective pixel units 70 is not influenced. Accordingly, in the second embodiment, the same advantages as those in the first embodiment can be obtained.

3: Third Embodiment

Next, an electro-optical device according to a third embodiment of the invention will be described. In the third embodiment, a liquid crystal device serving as an electro-optical device has a different operation from the first embodiment. Accordingly, hereinafter, the operation of the liquid crystal device will be described with reference to FIGS. 14 to 16, laying emphasis on different parts from the first embodiment. Moreover, the same parts as those in the first embodiment are represented by the same reference numerals and the descriptions thereof will be omitted.

Figure 14:
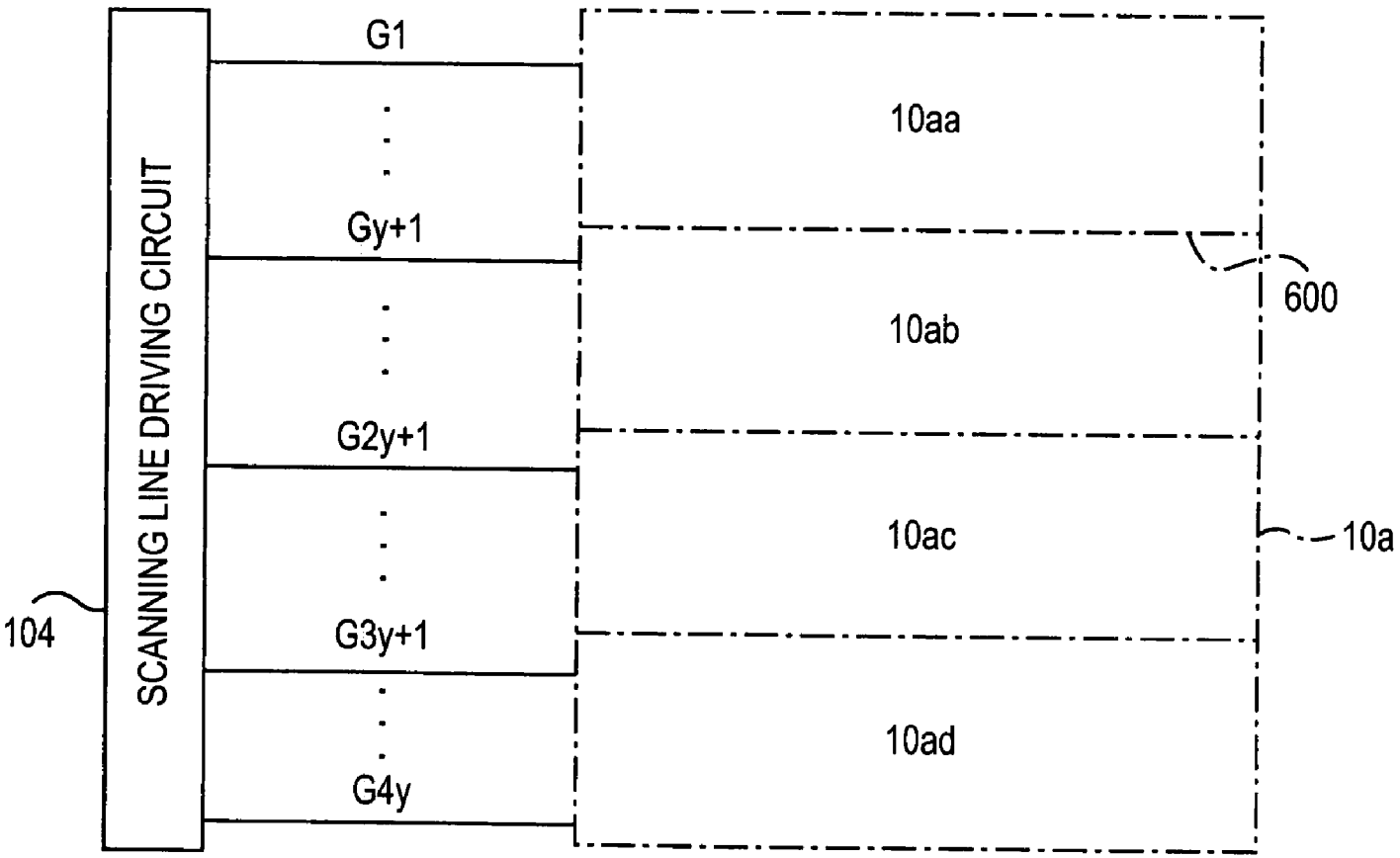
FIG. 14 is a diagram conceptually illustrating region scanning in a third embodiment.
Figure 15:
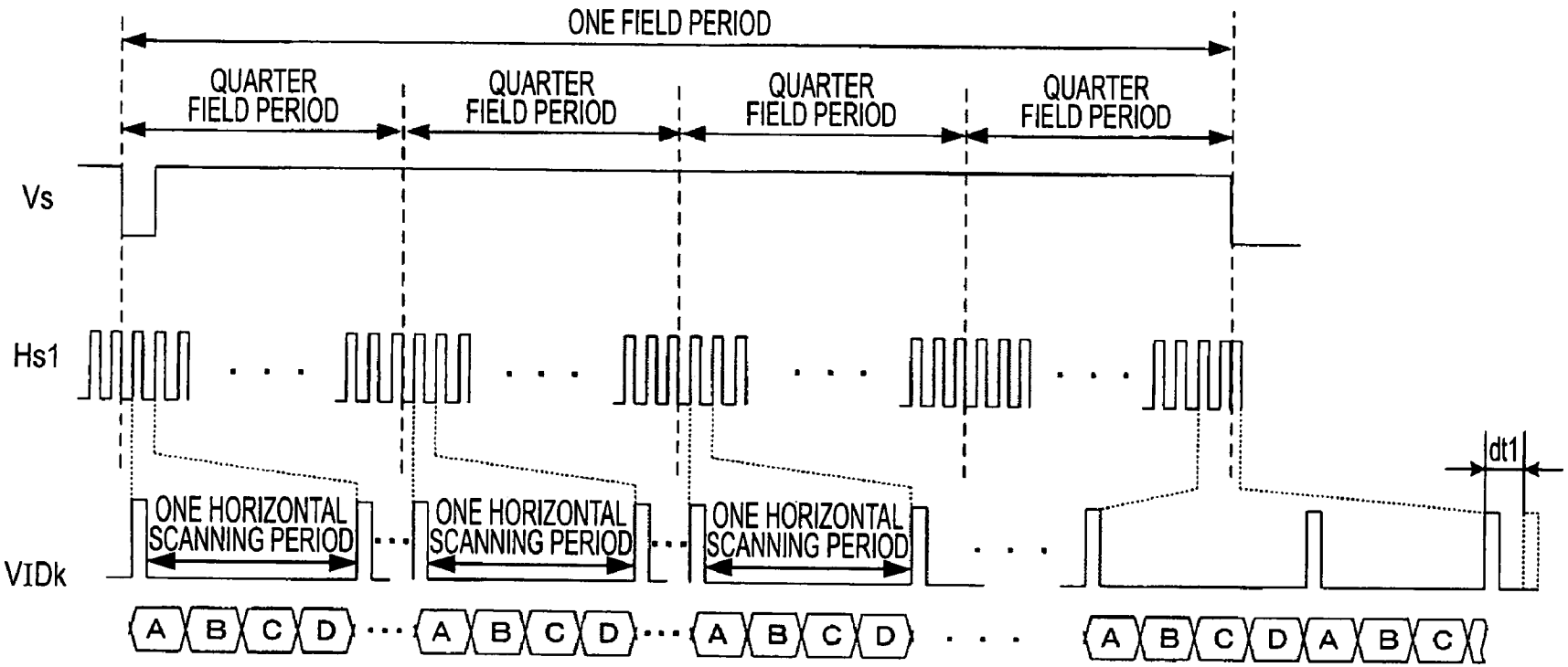
FIG. 15 is a diagram illustrating the generation of image signals in an image signal supply circuit of the third embodiment.
Figure 16:
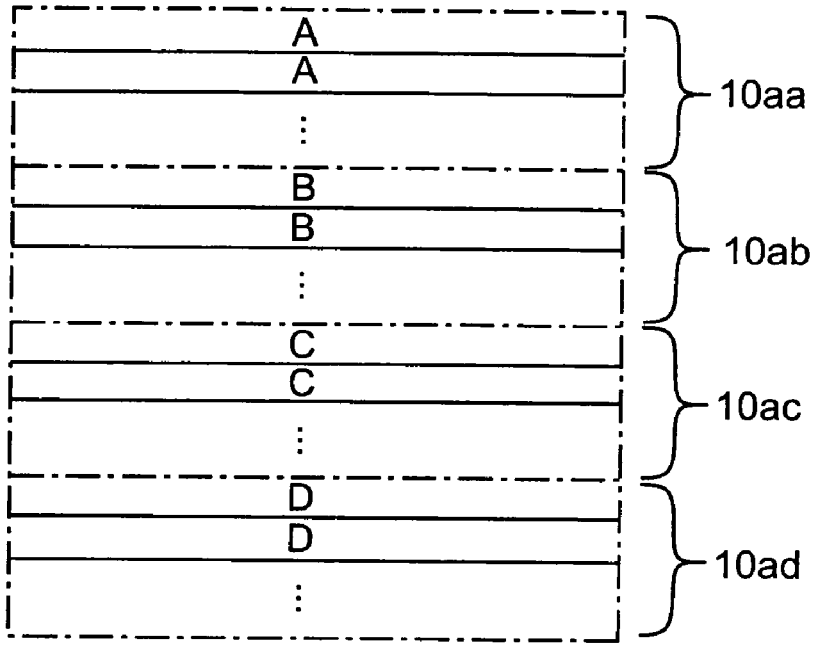
FIG. 16 is a diagram conceptually illustrating region scanning in the third embodiment.

FIGS. 14 and 16 are diagrams conceptually illustrating region scanning in the third embodiment. FIG. 15 is a diagram illustrating the generation of the image signal VIDk in an image signal supply circuit of the third embodiment. Moreover, in the third embodiment, the configuration of the liquid crystal device is the same as that in the first embodiment and thus it will be described with reference to FIGS. 3 and 4.

Hereinafter, it is assumed that the total number of scanning lines 112 is 4y, and a first partial region 10*aa*, a second partial region 10*ab*, a third partial region 10*ac*, and a fourth partial region 10*ad* obtained by quadrisecting the image display region 10*a* by the division lines 600 along the scanning lines 112 are subjected to region scanning, as shown in FIG. 14. That is, in a case in which the total number n of the plurality of partial regions is four, region scanning will be described.

In the third embodiment, the image signal supply circuit 300 generates four field data based on display data D0. Moreover, in the third embodiment, instead of the first and second frame memories 62 and 63 shown in FIG. 3, four frame memories are provided. Four field data are temporarily stored in any one of the four frame memories at a cycle that the scanning signal is supplied to one scanning line and one stored field data is read out from any one of the four frame memories.

Referring to FIG. 15, in one field period, the image signal supply circuit 300 generates the image signal VIDk for displaying one screen on the image display region 10*a* based on one field data for each quarter field period. At this time, in one horizontal scanning period, the image signal supply circuit 300 adjusts the display voltage of the image signal VIDk for each quarter horizontal scanning period. Referring to FIG. 15, the image signals VIDk generated for each quarter horizontal scanning period by adjusting the display voltage in such a manner is referred to as four image signals A, B, C, and D. In the image signal supply circuit 300, the four image signals A, B, C, and D are adjusted to one of the positive voltage and the negative voltage with respect to the reference potential v0.

As shown in FIG. 15, in one horizontal scanning period, the image signal A, the image signal B, the image signal C, and the image signal D are sequentially supplied from the image signal supply circuit 300 for each quarter horizontal scanning period. In addition, the image signal supply circuit 300 inverts the polarities of the four image signals A, B, C, and D with respect to the reference potential v0 for each quarter field period.

Next, region scanning in the quarter field period will be described with reference to FIG. 16.

In the third embodiment, the scanning signal Gj is alternately supplied to the first partial region 112, the second partial region 10*ab*, the third partial region 10*ac*, and the fourth partial region 10*ad* from the scanning line driving circuit 104 in one horizontal scanning period. Further, in the quarter field period, in the first partial region 10*aa*, the second partial region 10*ab*, the third partial region 10*ac*, and the fourth partial region 10*ad*, the scanning signal Gj is sequentially supplied to the respective scanning lines 112 from the top of the partial region 10*aa*, 10*ab*, 10*ac*, or 10*ad* to the bottom thereof along the arrangement direction of the scanning lines 112. Moreover, in one horizontal scanning period, the scanning signal Gj is sequentially supplied to the first partial region 10*aa*, the second partial region 10*ab*, the third partial region 10*ac*, and the fourth partial region 10*ad* for each quarter horizontal scanning period.

Accordingly, as shown in FIG. 16, in each horizontal scanning period of the quarter field period, the pixel units 70 corresponding to the scanning lines 10*aa* of the first partial region 10*aa* are subjected to horizontal scanning in the quarter horizontal scanning period and the image signal A is written into these pixel units 70. Then, in the next quarter horizontal scanning period subsequent to that quarter horizontal scanning period, the pixel units 70 corresponding to the scanning line 112 of the second partial region 10*ab* are subjected to horizontal scanning and the image signal B is written into these pixel units 70. Next, in a third quarter horizontal scanning period of one horizontal scanning period, the pixel units 70 corresponding to the scanning line 112 of the third partial region 10*ac* are subjected to horizontal scanning and the image signal C is written into these pixel units 70. Then, in the last quarter horizontal scanning period, the pixel units 70 corresponding to the scanning line 112 of the fourth partial region 10*ad* are subjected to horizontal scanning and the image signal D is written into these pixel units 70. As a result, in the quarter field period, one screen is displayed on the image display region 10*a*. Moreover, the image signal supply circuit 300 generates the image signals A, B, C, and D such that two partial regions in pairs among the first partial region 10*aa*, the second partial region 10*ab*, the third partial region 10*ac*, and the fourth partial region 10*ad* are driven based on the image signals having different polarities from each other. As a result, the voltage polarities of the image signals A, B, C, and D are inverted for each quarter field period and thus the first partial region 10*aa*, the second partial region 10*ab*, the third partial region 10*ac*, and the fourth partial region 10*ad* are subjected to surface inversion driving.

In the third embodiment, referring to FIG. 15, the deviation dt1 from the constant period of the last horizontal scanning period of one field period is adjusted to be equal to or shorter than the quarter horizontal scanning period by the correction circuit 501.

In the last horizontal scanning period, the image signal D is written into the pixel units 70 corresponding to the last scanning line 112 of the fourth partial region 10*ad* in the last quarter horizontal scanning period. Accordingly, the write operation of the image signal D to the pixel units 70 corresponding to the last scanning line 112 may not be normally performed. However, since the pixel units 70 corresponding to the last scanning line 112 of the fourth partial region 10*ad* are disposed at the edge of the image display region 10*a*, the display failure does not occur to the extent that it can be viewed on the display screen. Further, if the last horizontal scanning period ends in the vertical retrace period, the write operation of the image signal to the respective pixel units 70 is normally performed in the image display region 10*a*, and thus the display screen is not influenced. Accordingly, in the third embodiment, the same advantages as those in the first and second embodiments can be obtained.

<4: Electronic Apparatus>

Next, cases in which the above-described liquid crystal device is applied to various electronic apparatuses will be described.

<4-1: Projector>

Figure 17:
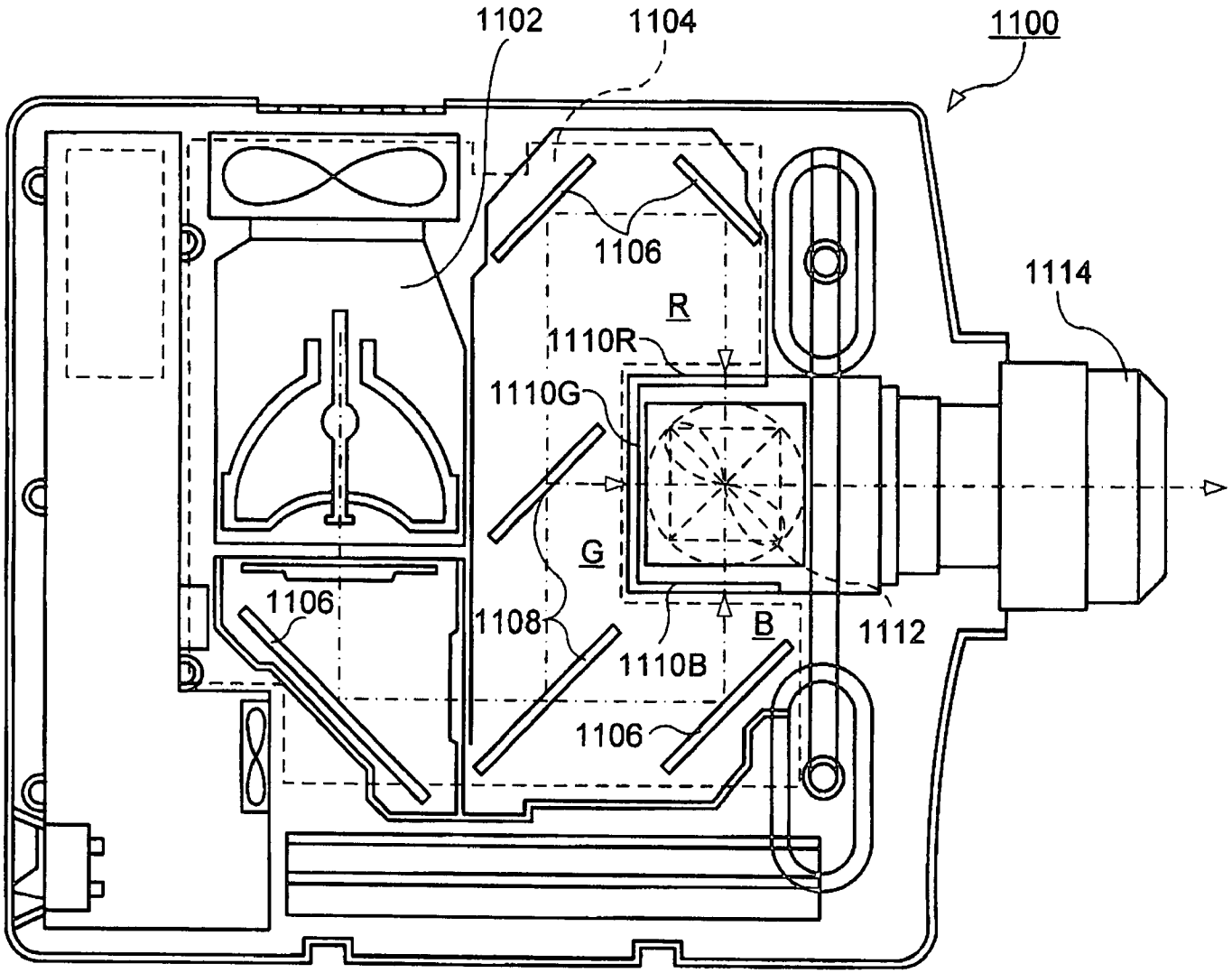
FIG. 17 is a plan view showing a configuration of a projector as an example of an electronic apparatus, to which a liquid crystal device is applied.

First, a projector that uses the liquid crystal device as a light valve will be described. FIG. 17 is a plan view showing an example of the configuration of the projector. As shown in FIG. 17, the projector 1100 includes a lamp unit 1102 having a white light source such as a halogen lamp. Light projected from the lamp unit 1102 is divided into three primary color light components of RGB by four mirrors 1106 and two dichroic mirrors 1108 provided in a light guide 1104. The three primary color light components enter light valves 1110R, 1110B, and 1110G, respectively, which serve as light valves corresponding to the respective primary colors. The three light valves 1110R, 1110B, and 1110G are constituted using liquid crystal modules having the liquid crystal devices, respectively.

The liquid crystal panels 100 in the light valves 1110R, 1110B, and 1110G are driven by the signals for the primary colors, R, G, and B supplied from the image signal supply circuit 300, respectively. The light components modulated by the liquid crystal panels 100 enter a dichroic prism 1112 from three directions. In the dichroic prism 1112, the light components of R and B are refracted at an angle of 90 degrees, while the light component of G travels in a straight line. Thus, images of the respective colors are combined and color images are projected through a projection lens 1114 onto a screen or the like.

Here, paying attention to the display images by the respective light valves 1110R, 1110B, and 1110G, a display image formed by the light valve 1110G must be horizontally reversed to the display images formed by the light valves 1110R and 1110B.

Moreover, since the light components corresponding to the three primary colors of R, G, and B enter the light valves 1110R, 1110B, and 1110G by the dichroic mirrors 1108, color filters need not be provided.

<4-2: Mobile Computer>

Figure 18:
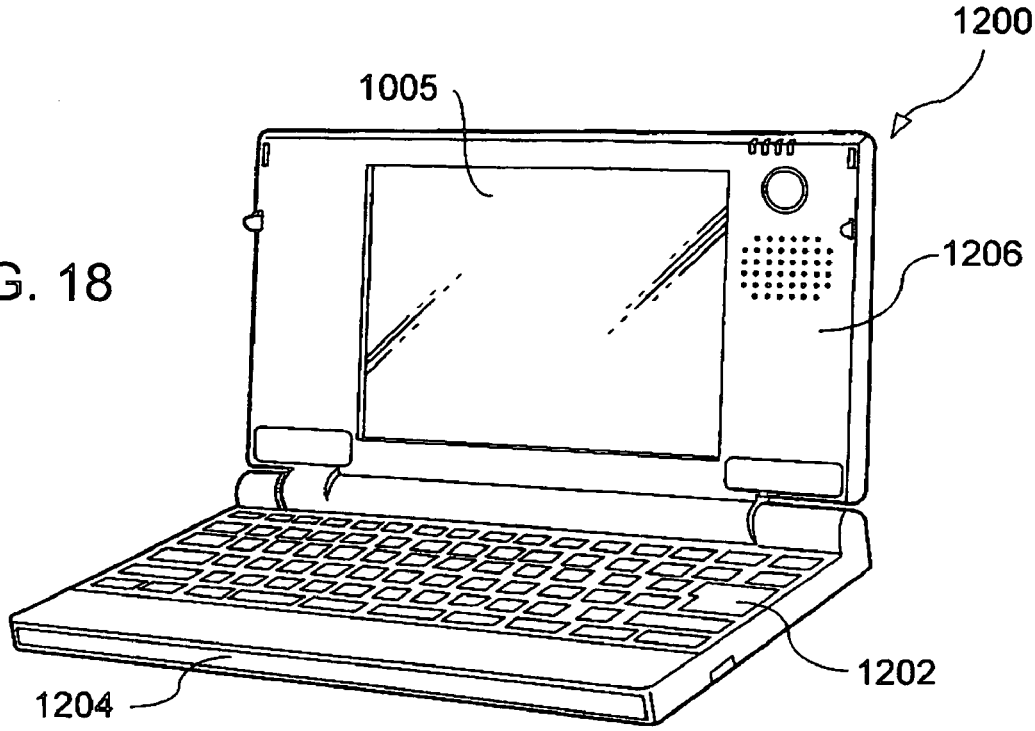
FIG. 18 is a perspective view showing a configuration of a personal computer as another example of an electronic apparatus, to which a liquid crystal device is applied.

Next, an example in which the liquid crystal device is applied to a mobile personal computer will be described. FIG. 18 is a perspective view showing the configuration of the personal computer. In FIG. 18, the computer 1200 includes a main unit 1204 including a keyboard 1202 and a liquid crystal display unit 1206. The liquid crystal display unit 1206 is formed by additionally providing a back light on the rear surface of the liquid crystal device 1005 as mentioned above.

<4-3: Cellular Phone>

Figure 19:
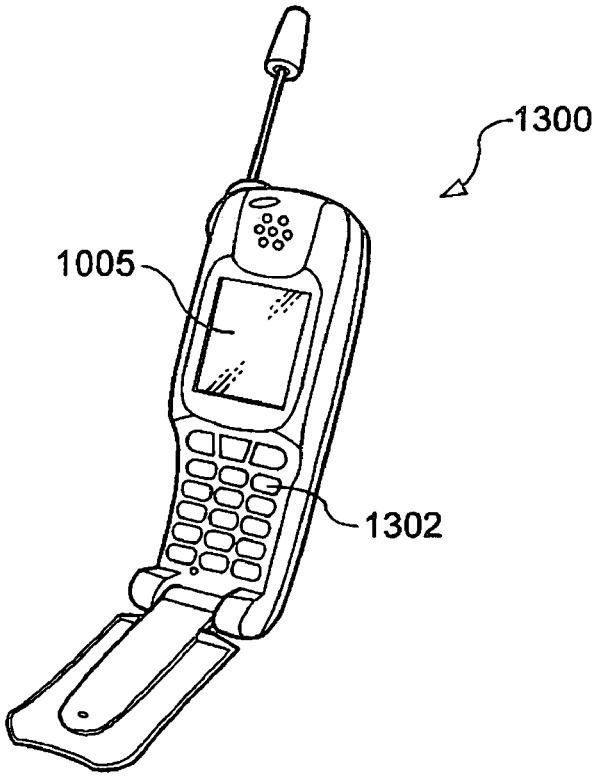
FIG. 19 is a perspective view showing a configuration of a cellular phone as still another example of an electronic apparatus, to which a liquid crystal device is applied.

Next, an example in which the liquid crystal device is applied to a cellular phone will be described. FIG. 19 is a perspective view showing the configuration of the cellular phone. In FIG. 19, the cellular phone 1300 includes a plurality of operation buttons 1302 and a reflective liquid crystal device 1005. In the reflective liquid crystal device 1005, a front light is provided on the front surface thereof, if necessary.

Moreover, in addition to the electronic apparatuses described with reference to FIGS. 17 to 19, a liquid crystal television, a view-finder-type or monitor-direct-view-type video tape recorder, a car navigation device, a pager, an electronic organizer, an electronic calculator, a word processor, a work station, a video phone, a POS terminal, and a device including a touch panel can be exemplified. It is needless to say that the liquid crystal device can be applied to these electronic apparatuses.

It should be understood that the invention is not limited to the above-described embodiment, and modifications can be made within the scope without departing from the subject matter or spirit of the invention as defined by the appended claims and the entire specification. Therefore, a driving circuit and a driving method for an electro-optical device, an electro-optical device having the driving circuit, and an electronic apparatus having the electro-optical device that accompany such modifications still fall within the technical scope of the invention.

What is claimed is:

1. A driving circuit for an electro-optical device that drives an electro-optical device having, on an image display region on a substrate, a plurality of data lines and a plurality of scanning lines, and a plurality of pixel units electrically connected to the scanning lines and the data lines, the driving circuit for an electro-optical device comprising:

a scanning line driving circuit that, with respect to a plurality of partial regions, which are obtained by dividing the image display region by division lines along the scanning lines, supplies scanning signals alternately to the scanning lines in the different partial regions, such that supplying a scanning signal to a first partial region is immediately followed by supplying another scanning signal to a second partial region before sending any scanning signal to the first partial region again, the first and second partial regions being different partial regions; and an image signal supply circuit that generates image signals based on display data and supplies the image signals to the plurality of data lines, wherein each field period, which is defined by a vertical synchronizing signal according to display data, has a vertical retrace period and each of the plurality of the partial regions is subjected to horizontal scanning in a 1/n horizontal scanning period obtained by dividing one horizontal scanning period, which is defined by a horizontal synchronizing signal according to display data, by the total number n, where n is a natural number of two or more, of the plurality of partial regions, and the scanning line driving circuit supplies the scanning signals such that a supply sequence of the scanning signals to one scanning line, which is disposed at an edge of one side along the scanning lines in the image display region, among the plurality of scanning lines becomes last for each field period.

2. The driving circuit for an electro-optical device according to claim 1, wherein the image signal supply circuit generates the image signals such that the image display region is subjected to vertical scanning in a 1/n field period obtained by dividing one field period by the total number n.

3. The driving circuit for an electro-optical device according to claim 1, wherein the image signal supply circuit generates the image signals while adjusting polarities of the image signals to any one of positive and negative voltages with respect to a reference potential.

4. The driving circuit for an electro-optical device according to claim 1, wherein the number of the plurality of partial regions is two, and the scanning line driving circuit supplies the scanning signals alternately to the two partial regions and linear-sequentially to the scanning lines in the respective partial regions.

5. The driving circuit for an electro-optical device according to claim 1, wherein the number of the plurality of partial regions is four, and the scanning line driving circuit supplies the scanning signals alternately to the four partial regions and linear-sequentially to the scanning lines in the respective partial regions.

6. An electro-optical device comprising the driving circuit for an electro-optical device according to claim 1.

7. An electronic apparatus comprising the electro-optical device according to claim 6.

8. A driving circuit for an electro-optical device that drives an electro-optical device having, on an image display region on a substrate, a plurality of data lines and a plurality of scanning lines, and a plurality of pixel units electrically connected to the scanning lines and the data lines, the driving circuit for an electro-optical device comprising:

a scanning line driving circuit that, with respect to a plurality of partial regions, which are obtained by dividing the image display region by division lines along the scanning lines, supplies scanning signals alternately to the scanning lines in the different partial regions;

an image signal supply circuit that generates image signals based on display data and supplies the image signals to the plurality of data lines; and a correction circuit that adjusts the length of a last horizontal scanning period in one field period based on the vertical synchronizing signal and the horizontal synchronizing signal such that the last horizontal scanning period ends in a period from the start of a supply period of a last scanning signal to the end of the vertical retrace period, wherein each field period, which is defined by a vertical synchronizing signal according to display data, has a vertical retrace period and each of the plurality of the partial regions is subjected to horizontal scanning in a 1/n horizontal scanning period obtained by dividing one horizontal scanning period, which is defined by a horizontal synchronizing signal according to display data, by the total number n, where n is a natural number of two or more, of the plurality of partial regions, and the scanning line driving circuit supplies the scanning signals such that a supply sequence of the scanning signals to one scanning line, which is disposed at an edge of one side along the scanning lines in the image display region, among the plurality of scanning lines becomes last for each field period.

9. A driving method for an electro-optical device that drives an electro-optical device having, on an image display region on a substrate, a plurality of data lines and a plurality of scanning lines, and a plurality of pixel units electrically connected to the scanning lines and the data lines, the driving method for an electro-optical device comprising:

supplying, with respect to a plurality of partial regions, which are obtained by dividing the image display region by division lines along the scanning lines, scanning signals alternately to the scanning lines in different partial regions, such that supplying a scanning signal to a first partial region is immediately followed by supplying another scanning signal to a second partial region before sending any scanning signal to the first partial region again, the first and second partial regions being different partial regions; and generating image signals based on display data and supplying the image signals to the plurality of data lines, wherein, each field period, which is defined by a vertical synchronizing signal according to display data, has a vertical retrace period and each of the plurality of the partial regions is subjected to horizontal scanning in a 1/n horizontal scanning period obtained by dividing one horizontal scanning period, which is defined by a horizontal synchronizing signal according to display data, by the total number n, where n is a natural number of two or more, of the plurality of partial regions, and in supplying the scanning signals, the scanning signals are supplied such that a supply sequence of the scanning signals to one scanning line disposed at an edge of one side along the scanning lines in the image display region among the plurality of scanning lines becomes last for each field period.

10. The driving method for an electro-optical device according to claim 9, wherein, in generating the image signals, the image signals are generated such that the image display region is subjected to vertical scanning in a 1/n field period obtained by dividing one field period by the total number n.

11. The driving method for an electro-optical device according to claim 9, wherein, in generating the image signals, the image signals are generated while polarities of the image signals are adjusted to any one of positive and negative voltages with respect to a reference potential.

* * * * *